US010260273B2

(12) United States Patent
Yokote et al.

(10) Patent No.: US 10,260,273 B2
(45) Date of Patent: Apr. 16, 2019

(54) MEDIUM STORAGE BOX AND MEDIUM HANDLING DEVICE

(71) Applicant: Oki Electric Industry Co., Ltd., Tokyo (JP)

(72) Inventors: Takamoto Yokote, Tokyo (JP); Hirokazu Komatsu, Tokyo (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 0 days.

(21) Appl. No.: 15/542,680

(22) PCT Filed: Oct. 28, 2015

(86) PCT No.: PCT/JP2015/080432

§ 371 (c)(1),
(2) Date: Jul. 11, 2017

(87) PCT Pub. No.: WO2016/136029

PCT Pub. Date: Sep. 1, 2016

(65) Prior Publication Data

US 2017/0356233 A1 Dec. 14, 2017

(30) Foreign Application Priority Data

Feb. 25, 2015 (JP) ..... 2015-034822

(51) Int. Cl.
*E05G 1/12* (2006.01)
*E05G 5/00* (2006.01)
(Continued)

(52) U.S. Cl.
CPC ..... *E05G 1/12* (2013.01); *E05G 5/00* (2013.01); *G07D 9/00* (2013.01); *G07D 11/0081* (2013.01); *G08B 15/02* (2013.01)

(58) Field of Classification Search
CPC .... E05G 1/14; E05G 1/06; E05G 1/12; E05G 5/00; G07D 11/0081; G07D 9/00; G08B 15/02
(Continued)

(56) References Cited

U.S. PATENT DOCUMENTS 3,349,729 A * 10/1967 Georges ..... E05G 1/14 109/25
3,779,179 A * 12/1973 Marois ..... E05G 1/12 109/29
(Continued)

FOREIGN PATENT DOCUMENTS

EP 1209312 A2 5/2002
JP 2006-39775 A 2/2006
(Continued)

*Primary Examiner* — LLoyd A Gall
(74) *Attorney, Agent, or Firm* — Rabin & Berdo, P.C.

(57) ABSTRACT

The degrees of freedom are increased for the layout for a member (for example, an upper guide or the like that restricts an up-down direction position of a medium) to be disposed above a storage space for storing a paper sheet-shaped medium, and a disposable space for the member is enlarged. A medium storage box having an internal storage space for storing a paper sheet-shaped medium includes an upper installation member (for example, a lid section) that is disposed above the storage space, and a liquid ejection mechanism that ejects liquid from a liquid ejection nozzle. A liquid ejection direction of the liquid ejection nozzle is set in a direction toward a lower face of the upper installation member.

18 Claims, 13 Drawing Sheets

(51) Int. Cl.

| | |
|---|---|
| ***G08B 15/02*** | (2006.01) |
| ***G07D 9/00*** | (2006.01) |
| ***G07D 11/00*** | (2019.01) |

(58) Field of Classification Search
USPC ..... 109/20, 25, 29–34
See application file for complete search history.

(56) References Cited

U.S. PATENT DOCUMENTS

| | | | | |
|---|---|---|---|---|
| 3,797,412 | A * | 3/1974 | DiPaola | E05G 1/14 109/24 |
| 8,464,648 | B2 * | 6/2013 | Villiger | E05G 1/14 109/25 |
| 9,890,014 | B2 * | 2/2018 | Kobayashi | B65H 29/52 |
| 9,965,916 | B2 * | 5/2018 | Komatsu | G07D 9/00 |
| 2002/0029728 | A1 * | 3/2002 | Walker | E05G 1/14 109/25 |
| 2004/0154500 | A1 * | 8/2004 | Richard | E05G 1/005 109/25 |

FOREIGN PATENT DOCUMENTS

| | | | |
|---|---|---|---|
| JP | 2010-55134 | A | 3/2010 |
| JP | 4662811 | B2 | 3/2011 |
| JP | 2011-145939 | A | 7/2011 |

* cited by examiner

MEDIUM STORAGE BOX AND MEDIUM HANDLING DEVICE

TECHNICAL FIELD

The present invention relates to a medium storage box including a liquid ejection mechanism that ejects liquid to stain a medium during an occurrence of criminal activity (an emergency) such as destruction or theft, and a medium handling device loaded with the medium storage box.

BACKGROUND ART

Cash handling devices that handle cash are a conventional type of medium handling device that handles a medium. Cash handling devices are given functionality to eject liquid (ink) from a liquid ejection nozzle onto a medium (banknotes) to stain the medium during occurrences of criminal activity (an emergency) in which the cash handling device is destroyed and a medium (banknotes) stored therein are stolen. Herein, "stain" means a state in which liquid penetrates inside the medium. This functionality, for example, is implemented by providing a liquid ejection mechanism to a medium storage box loaded in the device (for example, see European Patent (EP) No. 1209312 and Japanese Patent Application Laid-Open (JP-A) No. 2011-145939).

Medium storage boxes are case-shaped storage boxes for internally storing a paper sheet-shaped medium. Medium storage boxes are often configured as a cassette unit that is attachable to and detachable from a device so as to be capable of being transported in a state detached from the device.

Were there to be an occurrence of the aforementioned criminal activity (an emergency), a liquid ejection mechanism would stain medium stored in a medium storage box so as to place the medium in a difficult-to-use condition. Liquid ejection mechanisms thereby prevent any stolen medium from being used. Moreover, were there an attempt to use the stolen medium, a liquid ejection mechanism makes it easier to discover the usage of the stolen medium and make it easier to identify the person who used the stolen medium, thereby deterring reoccurrence of the criminal activity (emergency).

SUMMARY OF INVENTION

Technical Problem

However, in conventional medium storage boxes, as explained below, there is an issue of it being desirable to enlarge a disposable space for a member to be disposed above a storage space for storing a paper sheet-shaped medium.

Among medium storage boxes, for example, there is configuration in which a liquid ejection nozzle is disposed above a storage space for storing a paper sheet-shaped medium (banknotes), and liquid is ejected directly onto a medium (banknotes) from the liquid ejection nozzle. Medium storage boxes with such a configuration are commonly horizontal-storage medium storage boxes, described later. However, medium storage boxes with such a configuration are not limited to horizontal-storage medium storage boxes; vertical-storage medium storage boxes, described later, with such a configuration also exist. In the following, medium storage boxes with such a configuration are referred to as "conventional medium storage boxes".

Herein, "horizontal-storage medium storage boxes" means medium storage boxes configured such that medium (banknotes) are stored superimposed on each other in the front-rear direction in a state in which the short sides (or long sides) of the medium (banknotes) are made to stand in the up-down direction. "Vertical-storage medium storage boxes" means medium storage boxes configured such that medium (banknotes) are stored with sheet faces thereof superimposed on each other in the up-down direction.

Note that the reason why medium storage boxes configured with a liquid ejection nozzle disposed above a medium (banknote) storage space are more commonly horizontal-storage medium storage boxes is because medium (banknotes) are stored in a standing state in horizontal-storage medium storage boxes, so liquid flows downward under its own weight along the sheet faces of the medium (banknotes) when the liquid is ejected onto the medium (banknotes) from above, resulting in a wide area on the medium (banknotes) being efficiently stained by a small amount of ink.

However, the liquid ejection nozzle is disposed above the storage space in conventional medium storage boxes. Accordingly, configuration is such that a disposable space for a member (for example, an upper guide or the like) to be disposed above the storage space is liable to be limited by the liquid ejection nozzle. In conventional medium storage boxes, it has therefore been desirable to enlarge the disposable space for a member to be disposed above the storage space.

Herein, an "upper guide" means a guide member that restricts the up-down direction position of the medium. An upper guide is configured such that the position at which it is disposed in the up-down direction can be changed as appropriate according to the size of the medium (banknotes) stored in the storage space. An upper guide is, for example, disposed above the storage space formed in horizontal-storage medium storage boxes.

However, the member disposed above the storage space is not limited to an upper guide. Various members (for example, rollers or the like) are also able to be envisaged. Accordingly, such an issue is not limited to horizontal-storage medium storage boxes. This issue relates to vertical-storage medium storage boxes as well.

In consideration of the above circumstances, an object of the present invention is to provide a medium storage box having an enlarged disposable space for a member (for example, an upper guide or the like) to be disposed above a storage space for storing a paper sheet-shaped medium, and a medium handling device loaded with the medium storage box.

Solution to Problem

In order to achieve the above object, a first aspect of the present invention is a medium storage box including an internal storage space for storing a paper sheet-shaped medium. The medium storage box includes an upper installation member that is disposed above the storage space, and a liquid ejection mechanism that ejects liquid from a liquid ejection nozzle. Configuration is such that a liquid ejection direction of the liquid ejection nozzle is set in a direction toward a lower face of the upper installation member.

The medium storage box is configured such that liquid is not ejected directly onto the medium from the liquid ejection nozzle, and instead is ejected toward a lower face of the upper installation member. In the medium storage box, when liquid is ejected toward the lower face of the upper installation member, the liquid flows along the lower face, and then drips down into the storage space from the lower face. The medium storage box thereby applies liquid to the medium stored in the storage space. In the medium storage box, the liquid ejection nozzle is not disposed above the storage space. Accordingly, the liquid ejection nozzle does not limit the disposable space for a member (for example, an upper guide or the like) to be disposed above the storage space. The medium storage box therefore enables a comparatively wide space to be secured above the storage space, and enables enlargement of a disposable space for a member (for example, an upper guide or the like) to be disposed above the storage space.

A second aspect of the present invention is a medium handling device that handles a medium. The medium handling device is configured for loading with the medium storage box according to the first aspect.

Advantageous Effects of Invention

The first aspect is capable of providing a medium storage box having an enlarged disposable space for a member to be disposed above a storage space for storing a paper sheet-shaped medium.

Moreover, the second aspect is capable of providing a medium handling device loaded with the medium storage box according to the first aspect.

DESCRIPTION OF EMBODIMENTS

Figure 1:
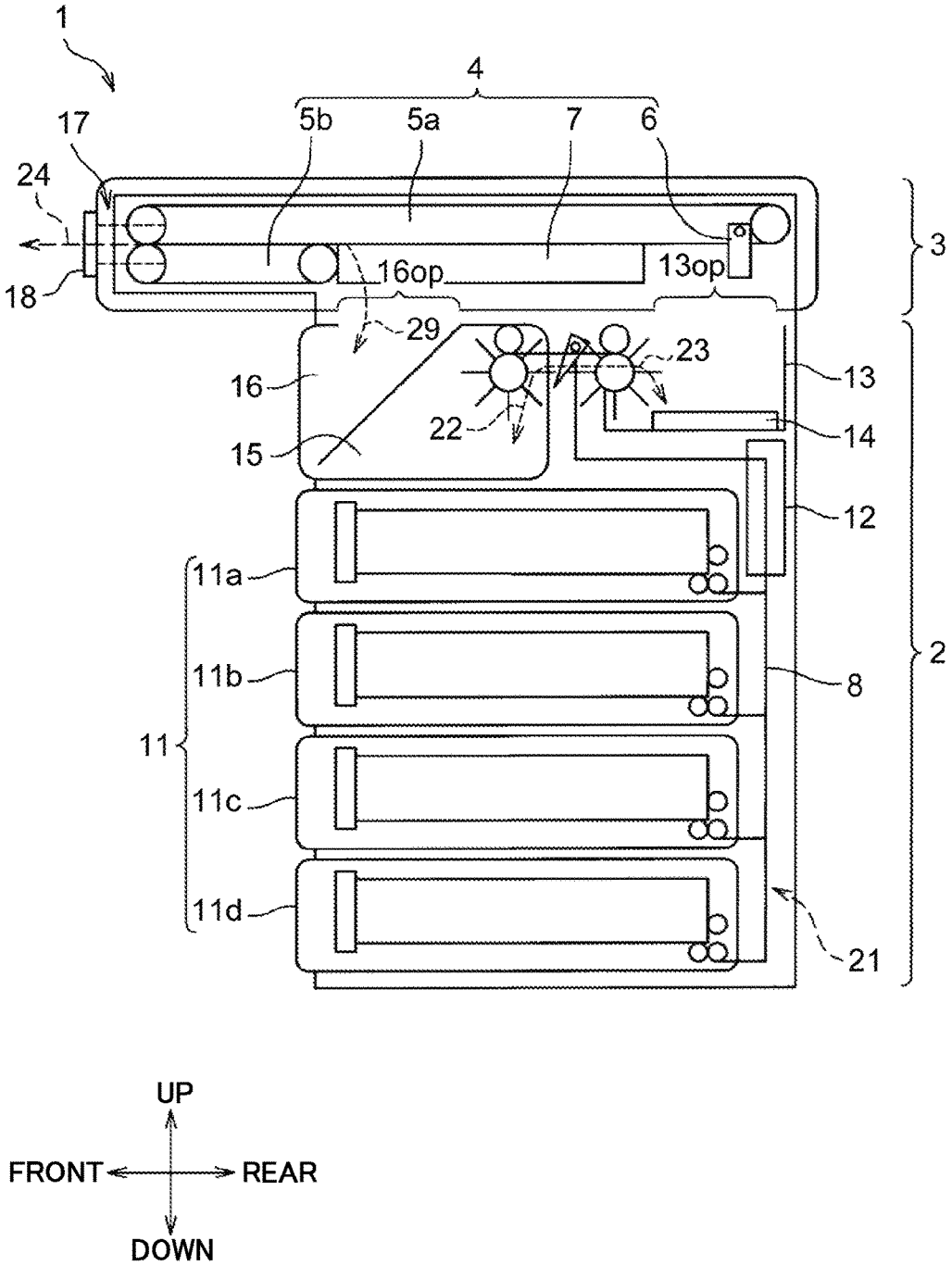
FIG. 1 is a diagram illustrating configuration of a medium handling device loaded with medium storage boxes according to a first exemplary embodiment.

Detailed explanation follows regarding embodiments for implementing the present invention (referred to below as exemplary embodiments), with reference to the drawings. Note that the drawings are schematic illustrations to enable sufficient understanding of the present invention. Thus, the present invention is not limited to the illustrated examples alone. In each of the drawings, common configuration elements and similar configuration elements are appended with the same reference numerals, and duplicate explanation thereof is omitted.

First Exemplary Embodiment

Explanation follows regarding a first exemplary embodiment in the order of (1) the configuration of a medium handling device loaded with medium storage boxes, (2) the configuration of a medium storage box exterior, (3) the configuration of a container section configuring a lower side of a medium storage box casing, (4) the configuration of a lid section configuring an upper side of a medium storage box casing, (5) the configuration of an upper guide employed in a medium storage box, (6) the configuration of a liquid ejection mechanism employed in a medium storage box, (7) the configuration of a medium storage box interior arrangement, (8) action during operation of a liquid ejection mechanism of a medium storage box, and (9) main features of a medium storage box.

(1) Configuration of Medium Handling Device Loaded with Medium Storage Boxes

Explanation follows regarding configuration of a medium handling device 1 loaded with medium storage boxes 11 according to the first exemplary embodiment, with reference to FIG. 1. FIG. 1 is a diagram illustrating configuration of the medium handling device 1.

The medium handling device 1 is, for example, a cash dispenser (CD), an automatic teller machine (ATM), or the like. Note that the following explanation envisages a case in which the medium handling device 1 is a cash dispenser (CD). Moreover, explanation follows in which the medium is banknotes.

Note that the respective "front", "rear", "right", and "left" directions illustrated in FIG. 1 indicate directions when viewing the medium handling device 1 from the perspective of a technician operating the medium handling device 1. Additionally, in the following, in cases in which a distinction is made between configuration elements disposed on a "right" side and configuration elements disposed on a "left" side, explanation is given with either the letter "R" suffix, indicating the "right" side, or the letter "L" suffix, indicating the "left" side, appended to the reference numeral given to the respective configuration elements.

As illustrated in FIG. 1, the medium handling device 1 includes a storage unit 2 that stores banknotes, and a bundle conveyance unit 3 that conveys banknote bundles. The storage unit 2 includes a conveyor path 8, medium storage boxes 11, a classification section 12, a stacking section 13, a reject storage box 15, a take-in storage box 16, a pay-out port 17, and a shutter 18. The bundle conveyance unit 3 includes an upper belt 5*a*, a lower belt 5*b*, a Scott-Russell plate 6, and a movable conveyor guide 7 that serve as a conveyor mechanism 4.

The conveyor path 8 is a path on which banknotes are conveyed. A conveyor mechanism (not illustrated in the drawings) that conveys banknotes is disposed in the vicinity of the conveyor path 8.

The medium storage boxes 11 are storage boxes for storing banknotes.

The classification section 12 is a device that classifies the denomination, the quantity, the eligibility for pay-out, and so on, of banknotes.

The stacking section 13 is a location where banknotes conveyed from the medium storage boxes 11 are stacked.

The reject storage box 15 is a storage box that, among the banknotes conveyed from the medium storage boxes 11, stores those banknotes that have been classified as unsuitable for pay-out by the classification section 12 (reject banknotes).

The take-in storage box 16 is a storage box that stores banknotes that have remained in the pay-out port 17 for a specific duration or greater.

The pay-out port 17 is a location where banknotes are discharged to the exterior of the medium handling device 1.

The shutter 18 is a member that selectively opens or closes the pay-out port 17.

The upper belt 5*a* and the lower belt 5*b* are members that sandwich banknotes in the up-down direction and convey these banknotes.

The Scott-Russell plate 6 is a member that pushes banknotes forward by moving forward from a position that is further rearward than a rear end of the banknotes.

The movable conveyor guide 7 is a member that selectively opens and closes an opening 13*op* provided above the stacking section 13 and an opening 16*op* provided above the take-in storage box 16 by moving along the front-rear direction.

The medium handling device 1 includes a pay-out route 21, a reject route 22, a stacking route 23, a dispensing route 24, and an take-in route 29 as banknote conveyance routes.

The pay-out route 21 is a route linking from the respective medium storage boxes 11 to the pay-out port 17.

The reject route 22 is a route linking a position between the stacking section 13 and the reject storage box 15 to the reject storage box 15.

The stacking route 23 is a route linking the position between the stacking section 13 and the reject storage box 15 to the stacking section 13.

The dispensing route 24 is a route linking a position between the upper belt 5*a* and the lower belt 5*b* to the pay-out port 17.

The take-in route 29 is a route linking the pay-out port 17 to the take-in storage box 16.

In the first exemplary embodiment, the medium handling device 1 is loaded with four of the medium storage boxes 11. In the following, in cases in which a distinction is made between the four medium storage boxes 11, they are referred to as medium storage boxes 11*a*, 11*b*, 11*c*, and 11*d* in sequence from the top.

Note that this explanation envisages a case in which the medium storage boxes 11 are horizontal-storage medium storage boxes (namely, medium storage boxes configured such that banknotes are stored superimposed on each other in the front-rear direction in a state in which the short sides (or long sides) of the banknotes are made to stand in the up-down direction).

In the first exemplary embodiment, the reject storage box 15 and the take-in storage box 16 are configured by a single storage box. Namely, in the medium handling device 1, the interior of a single storage box is divided into two spaces: one space being employed as the reject storage box 15 and the other space being employed as the take-in storage box 16.

In the first exemplary embodiment, the stacking section 13 and the reject storage box 15 are disposed adjacent to each other. The conveyor path 8 is formed from a position behind the bottom-most medium storage box 11*d*, passes behind the medium storage boxes 11*c*, 11*b*, and 11*a* and through the inside the classification section 12, and ends at a position between the stacking section 13 and the reject storage box 15. At the position between the stacking section 13 and the reject storage box 15, the conveyor path 8 branches toward the stacking section 13 side and toward the reject storage box 15 side.

The upper belt 5*a* and the lower belt 5*b* each run driven by a non-illustrated drive mechanism. The Scott-Russell plate 6 and the movable conveyor guide 7 similarly move driven by a non-illustrated drive mechanism. The drive mechanisms that drive these members may have the same drive source or may have different drive sources.

The upper belt 5*a* and the movable conveyor guide 7 are disposed facing each other in the up-down direction, and their respective facing portions are disposed so as to be in close contact with each other. The upper belt 5*a* and the lower belt 5*b* are also disposed facing each other in the up-down direction, and their respective facing portions are disposed so as to be in close contact with each other. The Scott-Russell plate 6 and the movable conveyor guide 7 are each formed in a shape that avoids the other such that they do not collide with each other when the Scott-Russell plate 6 or the movable conveyor guide 7 is moved.

The length of the upper belt 5*a* is longer than the combined length of the movable conveyor guide 7 and the lower belt 5*b*. The upper belt 5*a* is stretched between a roller pair respectively provided in the vicinity of a front end and in the vicinity of a rear end of the medium transaction device 1. One roller of the roller pair between which the upper belt 5*a* is stretched is a drive roller that is rotation driven to drive the upper belt 5*a*, and the other roller is a following roller that rotates following the movement of the upper belt 5*a*. The lower belt 5*b* is stretched between a roller pair respectively provided in the vicinity of the front end of the medium transaction device 1 and in the vicinity of the front of the opening 16*op*. Note that explanation follows envisaging a case in which one roller of the roller pair between which the lower belt 5*b* is stretched is a drive roller and the other roller is a following roller. However, both rollers of the roller pair between which the lower belt 5*b* is stretched may be following rollers.

In the above configuration, the medium handling device 1 operates in the following manner during pay-out.

First, the medium handling device 1 sequentially feeds out banknotes of a desired denomination from inside a medium storage box 11 holding this denomination to the conveyor path 8 according to an instruction from an operator, and conveys the fed-out banknotes along the pay-out route 21 to a position between the stacking section 13 and the reject storage box 15, classifying the banknotes in the classification section 12 en route.

The medium handling device 1 then conveys any banknotes classified as unsuitable for pay-out by the classification section 12 (reject banknotes) along the reject route 22 toward the reject storage box 15 side and stores these banknotes inside the reject storage box 15. The medium handling device 1 also conveys banknotes classified as suitable for pay-out by the classification section 12 along the stacking route 23 toward the stacking section 13 side and stores these banknotes inside the stacking section 13.

A stage 14 for stacking banknotes is disposed inside the stacking section 13. When a bundle of a desired quantity of banknotes has been stacked, the medium handling device 1 raises the stage 14. When this is performed, the movable conveyor guide 7 is moved to a position that opens the opening 13*op* in coordination with the raising of the stage 14. The Scott-Russell plate 6 retreats to a position where it does not collide with the banknotes.

When the stage 14 is raised, the medium handling device 1 runs the upper belt 5*a* and the lower belt 5*b* and moves the Scott-Russell plate 6 that was positioned further rearward than the rear end of the banknotes stacked on the stage 14 forward so as to move the banknote bundle stacked on the stage forward. Thereby, in the medium handling device 1, the banknote bundle is conveyed forward along the dispensing route 24 by the upper belt 5*a* and the lower belt 5*b* as the banknote bundle is pushed forward by the Scott-Russell plate 6.

The banknote bundle moves from on the stage 14 onto the movable conveyor guide 7 when this is performed. The banknote bundle then passes between the upper belt 5*a* and the movable conveyor guide 7, passes between the upper belt 5*a* and the lower belt 5*b*, and is conveyed to a position near the pay-out port 17.

When the banknote bundle has been conveyed to the position near the pay-out port 17, the medium handling device 1 opens the shutter 18 and runs the upper belt 5*a* and the lower belt 5*b*. The medium handling device 1 thereby conveys the banknote bundle forward. Part of the banknote bundle thereby adopts a state projecting out from the pay-out port 17 to the exterior. A customer is thereby able to take the banknote bundle from the medium handling device 1.

When the medium handling device 1 detects that the customer has taken the banknote bundle, the medium handling device 1 closes the shutter 18 and enters a state capable of responding to the next transaction.

However, when the banknote bundle has remained in the pay-out port 17 for a specific duration or greater without the banknote bundle being taken by the customer, the medium handling device 1 moves the movable conveyor guide 7 rearward, opens the opening 16*op*, and runs the upper belt 5*a* and the lower belt 5*b* such that the banknote bundle moves rearward. Thus, the medium handling device 1 takes the banknote bundle into the device interior along the take-in route 29 and stores, inside the take-in storage box 16, the banknotes that have been taken in. The medium handling device 1 then closes the shutter 18 and enters a state capable of responding to the next transaction.

In the above configuration, in the medium handling device 1, the vicinity of the medium storage box 11 is covered with a durable member in order to prevent illicit activity with respect to the medium storage box 11. However, despite this, it is possible for the medium handling device 1 to be broken and the medium storage boxes 11 stolen. Therefore, the medium storage boxes 11 are each provided with liquid ejection mechanisms 50 (see FIG. 4 and FIG. 6A). Herein, explanation envisages a case in which the liquid is ink. In the following, the liquid is referred to as ink.

The liquid ejection mechanisms 50 (see FIG. 4 and FIG. 6A) are mechanism that ejects ink on the medium (in this case, banknotes) stored in the medium storage box 11 and stain the medium when an occurrence of criminal activity (an emergency), such as the medium handling device 1 being destroyed, has been detected. When an emergency has occurred, the liquid ejection mechanisms 50 stain the medium so as to place the medium in a difficult-to-use condition. The liquid ejection mechanisms 50 thereby prevent stolen banknotes from being used. Moreover, were there to be an attempt to use the stolen banknotes, the liquid ejection mechanisms 50 make it easier to discover the usage of the stolen banknotes and make it easier to identify the person who used the stolen banknotes, thereby deterring reoccurrence of the criminal activity (emergency).

(2) Configuration of Medium Storage Box Exterior

Figure 2:
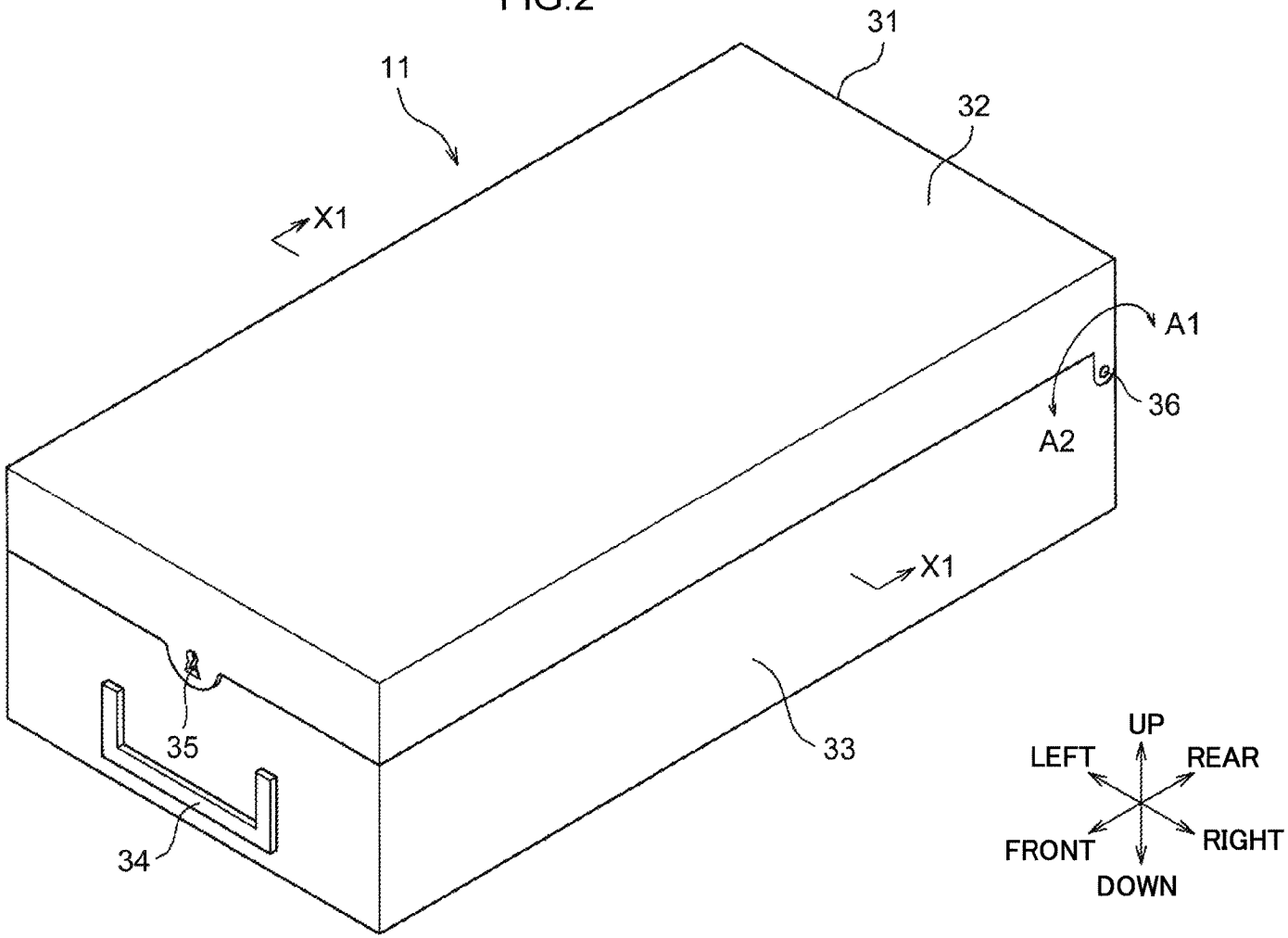
FIG. 2 is a diagram illustrating configuration of the exterior of a medium storage box according to the first exemplary embodiment.

Explanation follows regarding configuration of the exterior of the medium storage boxes 11, with reference to FIG. 2. Each medium storage box 11 is a case-shaped storage box for internally storing a paper sheet-shaped medium (banknotes in this case and hereafter).

As illustrated in FIG. 2, a casing 31 of the medium storage box 11 is formed in a box shape. The casing 31 includes a lid section 32 and a container section 33. The lid section 32 is an upper member configuring the upper side of the casing 31, and covers an upper portion of the container section 33. The container section 33 is a lower member configuring the lower side of the casing 31, and the medium is stored inside the container section 33.

The lid section 32 is attached to the container section 33 by a swing pivot 36 so as to be capable of swinging. The lid section 32 opens by swinging about the swing pivot 36 in the arrow A1 direction, and closes by swinging about the swing pivot 36 in the arrow A2 direction. Preferably, the casing 31 is configured such that the lid section 32 serving as an upper member and the container section 33 serving as a lower member are able to be separated. In the first exemplary embodiment, the lid section 32 is configured from a material that is ink-resistant.

In the example illustrated in FIG. 2, a handle 34 and a key hole 35 are provided to a front face of the medium storage box 11. The handle 34 is a location grippable by a technician. The key hole 35 is a hole into which a key is inserted in order to unlock a non-illustrated locking portion that locks the lid section 32 so as to be unable to swing.

Figure 3:
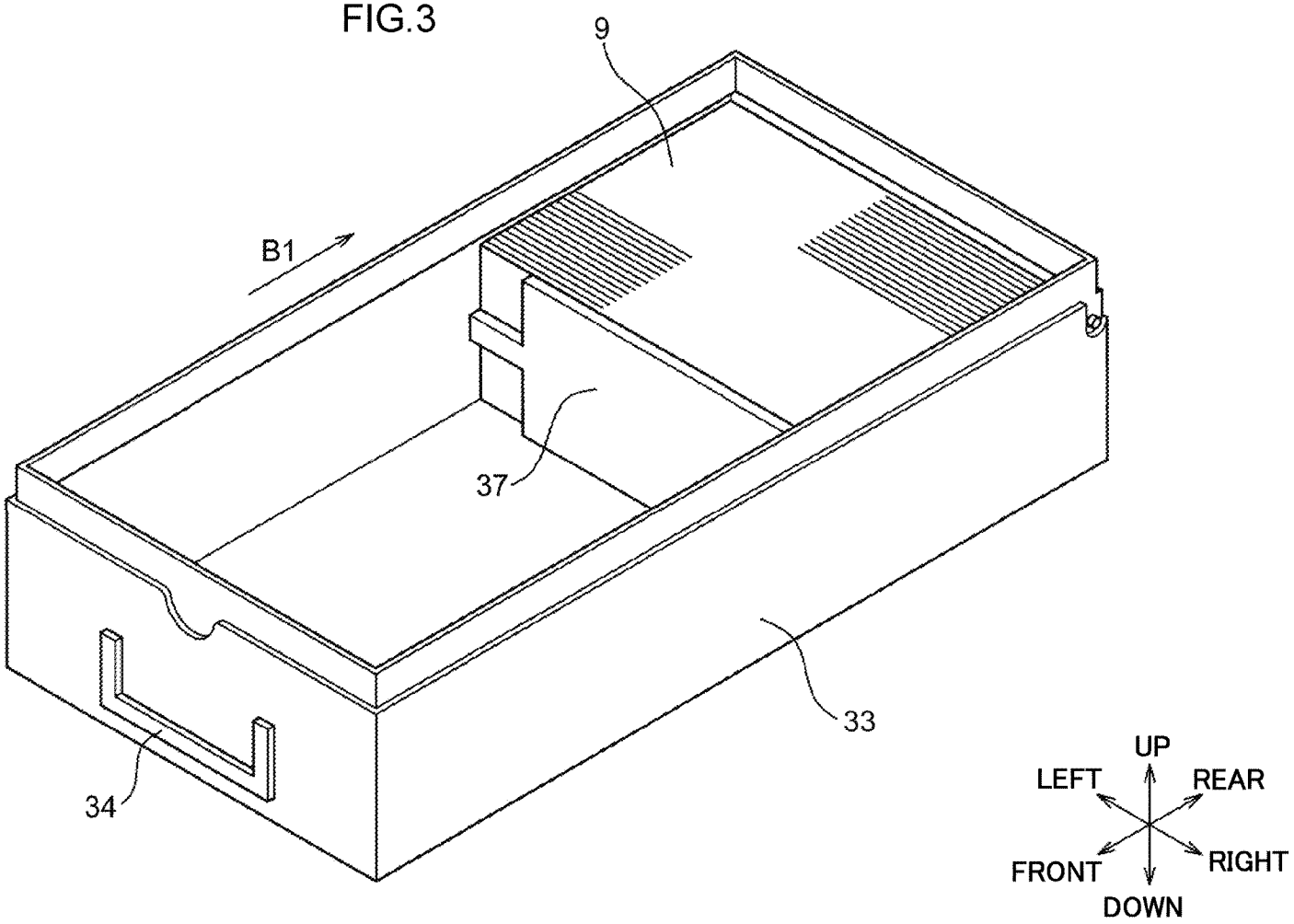
FIG. 3 is a diagram illustrating configuration of a container section configuring a lower side of a casing of a medium storage box according to the first exemplary embodiment.

(3) Configuration of Container Section Configuring Lower Side of Medium Storage Box Casing Explanation follows regarding configuration of the container section 33, with reference to FIG. 3.

As illustrated in FIG. 3, the container section 33 is configured such that several banknotes 9 are stored superimposed on each other in the front-rear direction in a state in which the short sides of the banknotes 9 are made to stand in the up-down direction. A press plate 37 is included inside the container section 33. The press plate 37 is a plate shaped member that presses the banknotes 9 in the arrow B1 direction. The press plate 37 is disposed in front of the banknotes 9, and is biased in the arrow B1 direction by a non-illustrated biasing member. A non-illustrated separator portion is disposed in the arrow B1 direction. During pay-out, the separator portion separates the several banknotes 9 one by one and feeds out the banknotes 9 through a non-illustrated opening to the conveyor path 8 (see FIG. 1).

Note that although not illustrated in FIG. 3, side guides 48 (see FIG. 7) and a lower guide 49 (see FIG. 7) are included inside the container section 33. In the present exemplary embodiment, two side guides 48R, 48L are respectively disposed to the right side and to the left side of a center CL (see FIG. 7) of the medium storage box 11. The side guides 48 and the lower guide 49 are explained in detail in the section titled "(7) Configuration of Medium Storage Box Interior" below.

Figure 4:
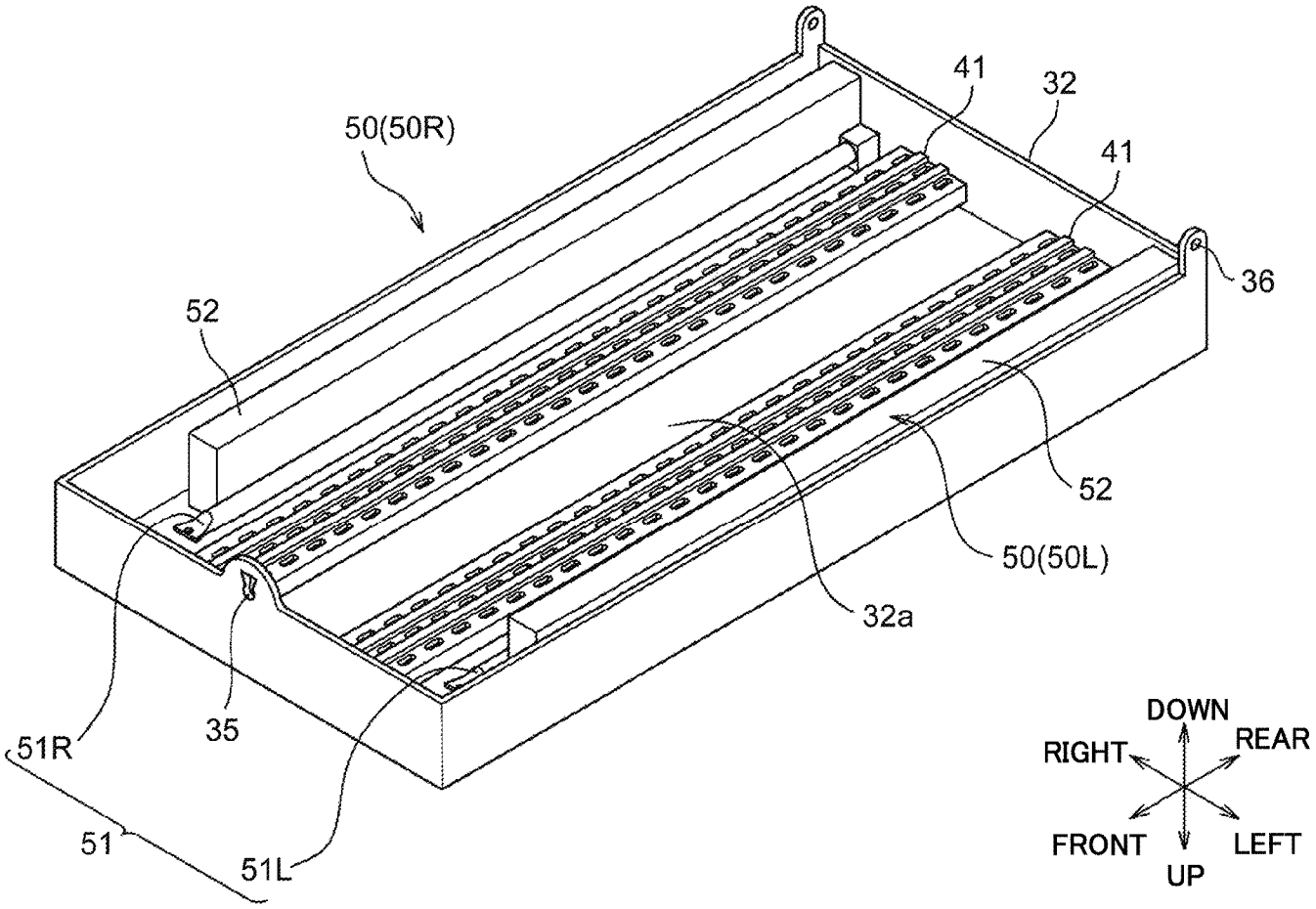
FIG. 4 is a diagram illustrating configuration of a lid section configuring an upper side of a casing of a medium storage box according to the first exemplary embodiment.

(4) Configuration of Lid Section Configuring Upper Side of Medium Storage Box Casing Explanation follows regarding configuration of the lid section 32, with reference to FIG. 4. FIG. 4 is a diagram illustrating configuration of the lid section 32 as viewed from a lower face 32*a* side.

As illustrated in FIG. 4, at a lower face 32*a*, the lid section 32 includes upper guides 41. The upper guides 41 are disposed above a storage space SP (see FIG. 7) and are guide members that define the up-down direction position of the banknotes 9. The upper guides 41 are explained in detail in the section titled "(5) Configuration of Upper Guide Employed in Medium Storage Box" below.

The liquid ejection mechanisms 50 mentioned above are provided on the lower face 32*a* of the lid section 32. Liquid ejection nozzles 51 and liquid tanks 52 are provided to the liquid ejection mechanisms 50. The liquid ejection nozzles 51 are members that eject ink. The liquid tanks 52 are containers that are pre-stored with ink. The liquid ejection nozzles 51 are disposed nearer to the storage space SP than the liquid tanks 52 (see FIG. 7). In the first exemplary embodiment, two liquid ejection mechanisms 50R, 50L are respectively disposed at a position displaced from the top of the storage space SP toward the right and at a position displaced from the top of the storage space SP toward the left (see FIG. 7). The right liquid ejection mechanism 50R and the left liquid ejection mechanism 50L have opposite left-right configurations. The liquid ejection mechanisms 50 are explained in detail in the section titled "(6) Configuration of Liquid Ejection Mechanism Employed in Medium Storage Box" below.

(5) Configuration of Upper Guide Employed in Medium Storage Box

Figure 5A:
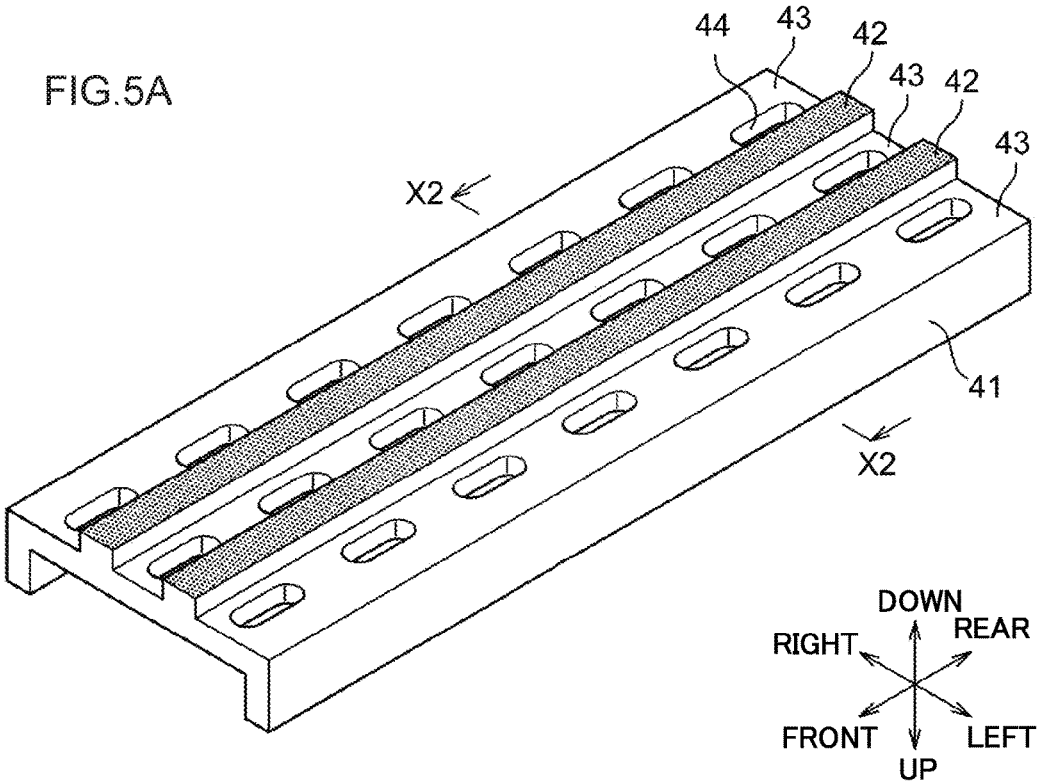
FIG. 5A and FIG. 5B are diagrams illustrating configuration of an upper guide employed in a medium storage box according to the first exemplary embodiment.
Figure 5B:
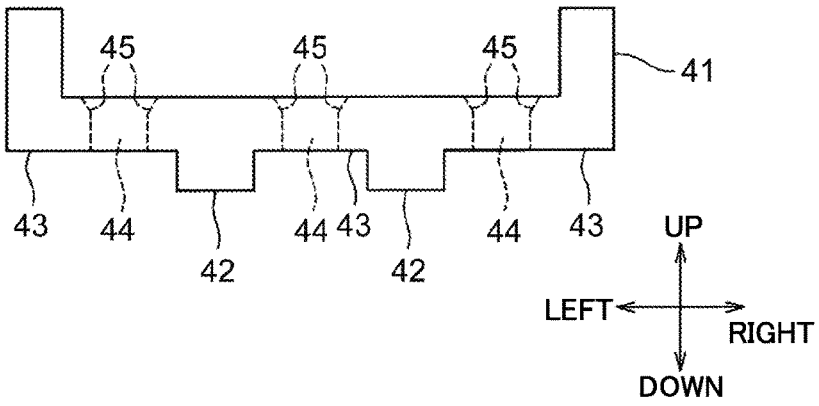

Explanation follows regarding configuration of the upper guides 41, with reference to FIG. 5A and FIG. 5B. FIG. 5A and FIG. 5B are diagrams illustrating configuration of an upper guide 41. FIG. 5A illustrates the shape of a lower face side of the upper guide 41. FIG. 5B illustrates a cross-section profile obtained by sectioning the upper guide 41 along the line X2-X2 illustrated in FIG. 5A.

As illustrated in FIG. 5A, the upper guide 41 has a shape in which a side face portion is bent upward from a lower face portion so as to secure a specific strength or greater and restrict the up-down direction position of the banknotes 9 stored in the storage space SP.

A lower face of the upper guide 41 has a shape in which flat faces 42 and flat faces 43 are formed alternating in a stepped shape. The flat faces 42 project out further downward than the flat faces 43. The flat faces 42 function as restricting faces that restrict the up-down direction position of the banknotes 9 stored in the storage space SP (see FIG. 7). In contrast thereto, flat faces 43 are faces that are not involved in restricting the up-down direction position of the banknotes 9. In the following, the flat faces 42 are referred to as "restricting faces 42" and the flat faces 43 are referred to as "non-restricting faces 43". Plural holes 44 that pierce through to an upper face of the upper guide 41 are formed in the non-restricting faces 43. Each of the holes 44 functions as a flow path through which ink that has accumulated on the upper face of the upper guide 41 drips downward on the banknotes 9 stored in the storage space SP (see FIG. 7).

As illustrated in FIG. 5B, chamfered portions 45 are formed at edge portions of the holes 44 on the upper face side of the upper guide 41. Namely, inclined faces that are inclined toward the holes 44 are formed at edge portions of the holes 44 by chamfering. The upper guide 41 is thereby configured such that the downward flow of ink that has accumulated on an upper face is promoted.

(6) Configuration of Liquid Ejection Mechanism Employed in Medium Storage Box

Figure 6A:
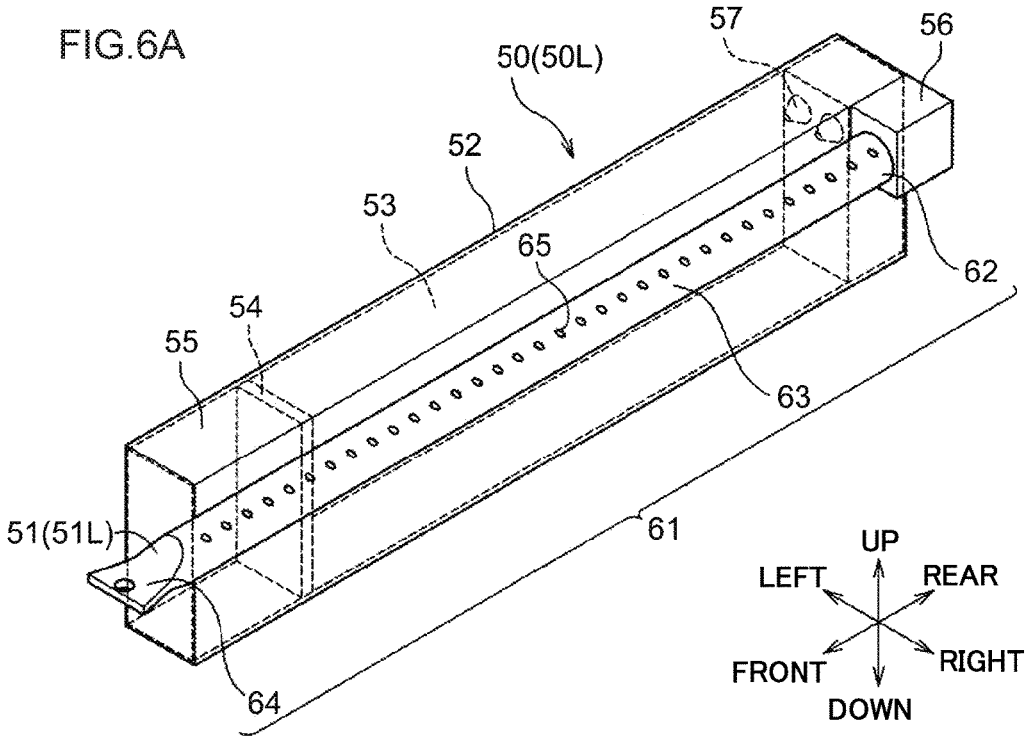
FIG. 6A, FIG. 6B and FIG. 6C are diagrams illustrating configuration of a liquid ejection mechanism employed in a medium storage box according to the first exemplary embodiment.
Figure 6B:
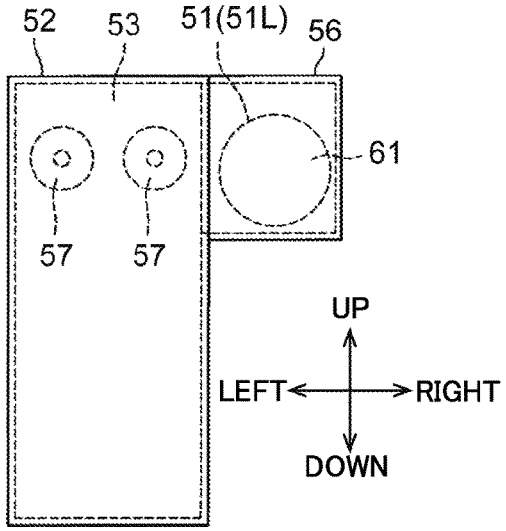
Figure 6C:
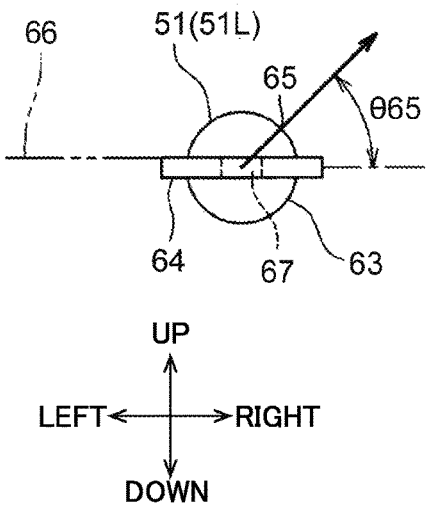

Explanation follows regarding configuration of the liquid ejection mechanisms 50, with reference to FIG. 6A, FIG. 6B and FIG. 6C. FIG. 6A, FIG. 6B and FIG. 6C are diagrams illustrating configuration of a liquid ejection mechanism 50. FIG. 6A illustrates configuration of the left liquid ejection mechanism 50L as viewed obliquely from the upper right. FIG. 6B illustrates configuration of the left liquid ejection mechanism 50L as viewed from the front. FIG. 6C illustrates the positional relationship between a crushed portion 64 and liquid ejection holes 65 formed to a left liquid ejection nozzle 51L.

As illustrated in FIG. 6A, the liquid ejection nozzle 51 includes an elongated circular tube shaped body section 61. In sequence from a route block 56, described below, the body section 61 is broadly divided into an inflow portion 62, a hollow portion 63, and the crushed portion 64.

The inflow portion 62 is coupled to the route block 56, described later, and is a portion into which ink flows from the route block 56 side.

The hollow portion 63 is formed in a hollow shape, and is a portion through which ink flows. Plural liquid ejection holes 65 are formed in a row pattern piercing from the inside to the outside of the hollow portion 63. The liquid ejection nozzle 51 ejects ink from the liquid ejection holes 65 to the outside.

The crushed portion 64 is a portion that has been crushed so as to have a flat plate shape. The crushed portion 64 is a structure tightly sealed such that ink cannot leak out. The crushed portion 64 is in close contact with a fixing face 66 (see FIG. 6C), described later.

The liquid tank 52 includes a storage portion 53, a liquid extrusion plate 54, a pressure generating portion (gas generator) 55, the route block 56, and ejection valves 57.

The storage portion 53 is a configuration element in which ink is pre-stored.

The liquid extrusion plate 54 is a plate shaped member that, during operation of the liquid ejection mechanism 50, moves toward the storage portion 53 side due to receiving pressure from the pressure generating portion 55 side and crushes the storage portion 53 toward the ejection valves 57 side.

The pressure generating portion 55 is a configuration element that, during operation of the liquid ejection mechanism 50, presses the liquid extrusion plate 54 toward the storage portion 53 side. The pressure generating portion 55 is, for example, configured by a gas generator.

The route block 56 is a member that couples the liquid tank 52 and the liquid ejection nozzle 51 together.

The ejection valves 57 are valves that seal ink inside the storage portion 53 while the liquid ejection mechanism 50 is not being operated and allow ink to flow to the route block 56 side during operation of the liquid ejection mechanism 50.

The ejection valves 57 are disposed between the liquid tank 52 and the route block 56. The ejection valves 57 are configured from a flexible material. The ejection valves 57 have shapes projecting out toward the 53 side while the liquid ejection mechanism 50 is not being operated. However, when the liquid ejection mechanism 50 is operated, the ejection valves 57 deform due to receiving pressure from the pressure generating portion 55 side and thus take on a shape projecting out toward the route block 56 side.

As illustrated in FIG. 6B, the liquid ejection nozzle 51 is disposed alongside the liquid tank 52. As illustrated in FIG. 6C, a fixing hole 67 is formed in the crushed portion 64 of the liquid ejection nozzle 51. The fixing hole 67 is a hole for fixing the fixing face 66 formed on the lower face 32*a* (see FIG. 4) side of the lid section 32 to the crushed portion 64 using a non-illustrated fastening member. The fixing face 66 is a face that is abutted against the crushed portion 64 and is for fixing the liquid ejection nozzle 51. The fixing face 66 is formed in a flat face shape. Explanation is given herein in which the fixing face 66 is formed so as to be substantially horizontal when the medium storage box 11 has been loaded into the medium handling device 1

The liquid ejection holes 65 of the liquid ejection nozzle 51 are uniformly formed in a wall portion of the hollow portion 63 so as to point obliquely upward from a horizontal plane passing through the central point in the liquid ejection nozzle 51 at a fixed angle θ65 about a central point in the liquid ejection nozzle 51.

(7) Configuration of Medium Storage Box Interior

Figure 7:
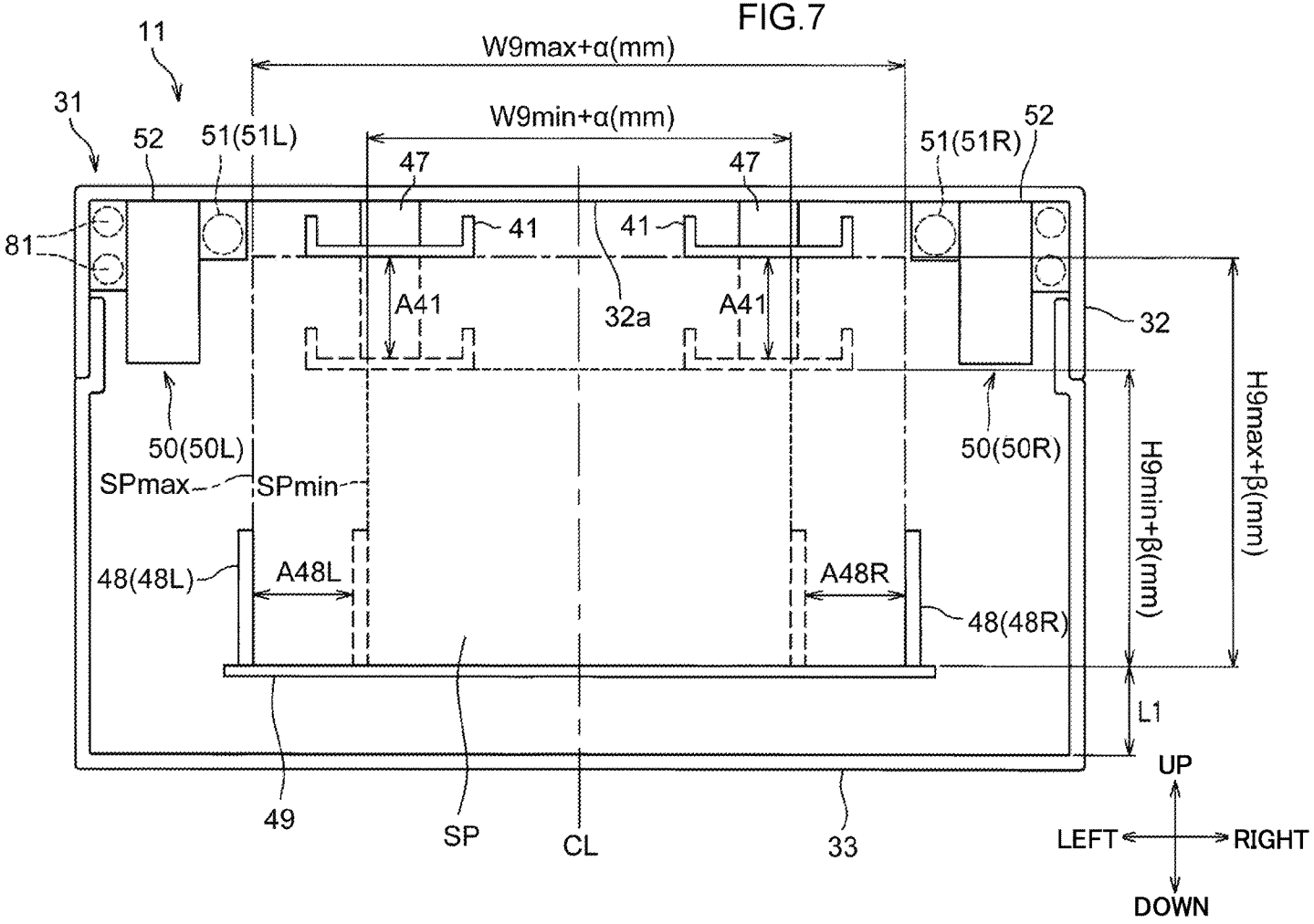
FIG. 7 is a diagram illustrating configuration of the inside of a medium storage box according to the first exemplary embodiment.

Explanation follows regarding configuration of the interior of a medium storage box 11, with reference to FIG. 7. FIG. 7 is a diagram illustrating configuration of the interior of the medium storage box 11. FIG. 7 illustrates a cross-section profile obtained by sectioning the casing 31 of the medium storage box 11 along the line X1-X1 illustrated in FIG. 2. In the first exemplary embodiment, the medium storage box 11 is configured such that ink is not ejected directly onto the banknotes 9 from the liquid ejection nozzles 51, and instead is ejected toward a lower face of a member (referred to below as an "upper installation member") disposed above the storage space SP. Herein, explanation envisages a case in which the "upper installation member" is the "lid section 32", and the "lower face of the upper installation member" is the "lower face 32*a* of the lid section 32". Explanation is also given in which the shape of the lower face 32*a* of the lid section 32 is a flat, horizontal face overall (particularly, the shape of at least a portion of the lower face 32*a* onto which ink is ejected is a flat, horizontal face).

As illustrated in FIG. 7, the interior of the medium storage box 11 is configured with left-right symmetry about the center CL of the medium storage box 11. The medium storage box 11 includes the upper guides 41, studs 47, side guides 48, and lower guide 49 mentioned above, and the liquid ejection mechanisms 50 mentioned above.

The studs 47 are members for attaching the upper guides 41 to the lower face 32*a* of the lid section 32.

The side guides 48 are disposed at the sides of the storage space SP in which the banknotes 9 (see FIG. 8) are stored, and are guide members that restrict the left-right direction position of the banknotes 9 (see FIG. 8) stored in the storage space SP.

The lower guide 49 is disposed at the bottom of the storage space SP, and is a guide member that supports the banknotes 9 (see FIG. 8) stored in the storage space SP from below.

In the first exemplary embodiment, the lower guide 49 is disposed at a position having a desired height L1 from a bottom face inside the medium storage box 11. The two side guides 48R, 48L are disposed on an upper face side of the lower guide 49. The right side guide 48R is attached to the upper face side of the lower guide 49 in a state in which its left-right direction (the arrow A48R direction) position is able to be changed using a non-illustrated attachment mechanism. The left side guide 48L is similarly attached to the upper face side of the lower guide 49 in a state in which its left-right direction (the arrow A48L direction) position is able to be changed using a non-illustrated attachment mechanism.

A space in which the upper guides 41 can be disposed in the up-down direction (the arrow A41 direction) is secured above the storage space SP in the medium storage box 11. In the medium storage box 11, the up-down direction position of the upper guide 41 can be changed as appropriate by using studs 47 of different lengths in accordance with the size of the banknotes 9 stored in the storage space SP. Namely, plural types of studs 47 with differing lengths are prepared in advance, and the studs 47 having a length corresponding to the size of the banknotes 9 stored in the storage space SP are employed. The studs 47 thereby function as adjustment members that adjust the up-down direction (the arrow A41 direction) position of the upper guides 41.

In the medium storage box 11, the positions of the upper guides 41 and the two side guides 48R, 48L are adjusted to match the size of the banknotes 9 (see FIG. 8) stored in the storage space SP.

A storage space SPmax is the space in which the positions of the upper guides 41 and the two side guides 48R, 48L have been adjusted to match the size of a maximum size medium. The storage space SPmax is referred to below as the "maximum size medium storage space SPmax". Herein, "maximum size medium" means the medium with the largest size in the width direction (or height direction) predicted to be used.

A storage space SPmin is the space in which the positions of the upper guides 41 and the two side guides 48R, 48L have been adjusted to match the size of a minimum size medium. The storage space SPmin is referred to below as the "minimum size medium storage space SPmin". Herein, "minimum size medium" means the medium with the smallest size in width direction (or height direction) predicted to be used.

The size of the maximum size medium storage space SPmax, with respect to the width direction size W9max and the height direction size H9max of the maximum size medium, is (W9max+α) (mm) in the width direction and (H9max+β) (mm) in the height direction.

Herein, α and β are freely selected values that are set as appropriate in accordance with the application.

In contrast thereto, the size of the minimum size medium storage space SPmin, with respect to the width direction size W9 min and the height direction size H9 min of the minimum size medium, is (W9 min+a) (mm) in the width direction and (H9 min+0) (mm) in the height direction.

The medium storage box 11 is configured such that the liquid ejection nozzles 51 are disposed between the lid section 32 and the upper guides 41, and are disposed at positions displaced from the top of the storage space SP (in this case, the maximum size medium storage space SPmax) toward the outside. The medium storage box 11 is also configured such that a liquid ejection direction (specifically, a central direction of ejection DILq (see FIG. 8)) of each liquid ejection nozzle 51 is set in the direction toward the lower face of the lid section 32.

Specifically, the right liquid ejection nozzle 51R is disposed between the lower face 32*a* of the lid section 32 and the upper guides 41 at a position displaced from the top of the storage space SP (in this case, the maximum size medium storage space SPmax) toward the right. The central direction of ejection DILq (see FIG. 8) of the right liquid ejection nozzle 51R is set in a direction toward the lower face 32*a* of the lid section 32.

The left liquid ejection nozzle 51L is disposed between the lower face 32*a* of the lid section 32 and the upper guides 41 at a position displaced from the top of the storage space SP (in this case, the maximum size medium storage space SPmax) toward the left. The central direction of ejection DILq (see FIG. 8) of the left liquid ejection nozzle 51L is set in a direction toward the lower face 32*a* of the lid section 32.

Such liquid ejection nozzles 51R, 51L respectively eject ink from an oblique downward direction onto the lower face 32*a* of the lid section 32.

(8) Action During Operation of Medium Storage Box Liquid Ejection Mechanism

Figure 8:
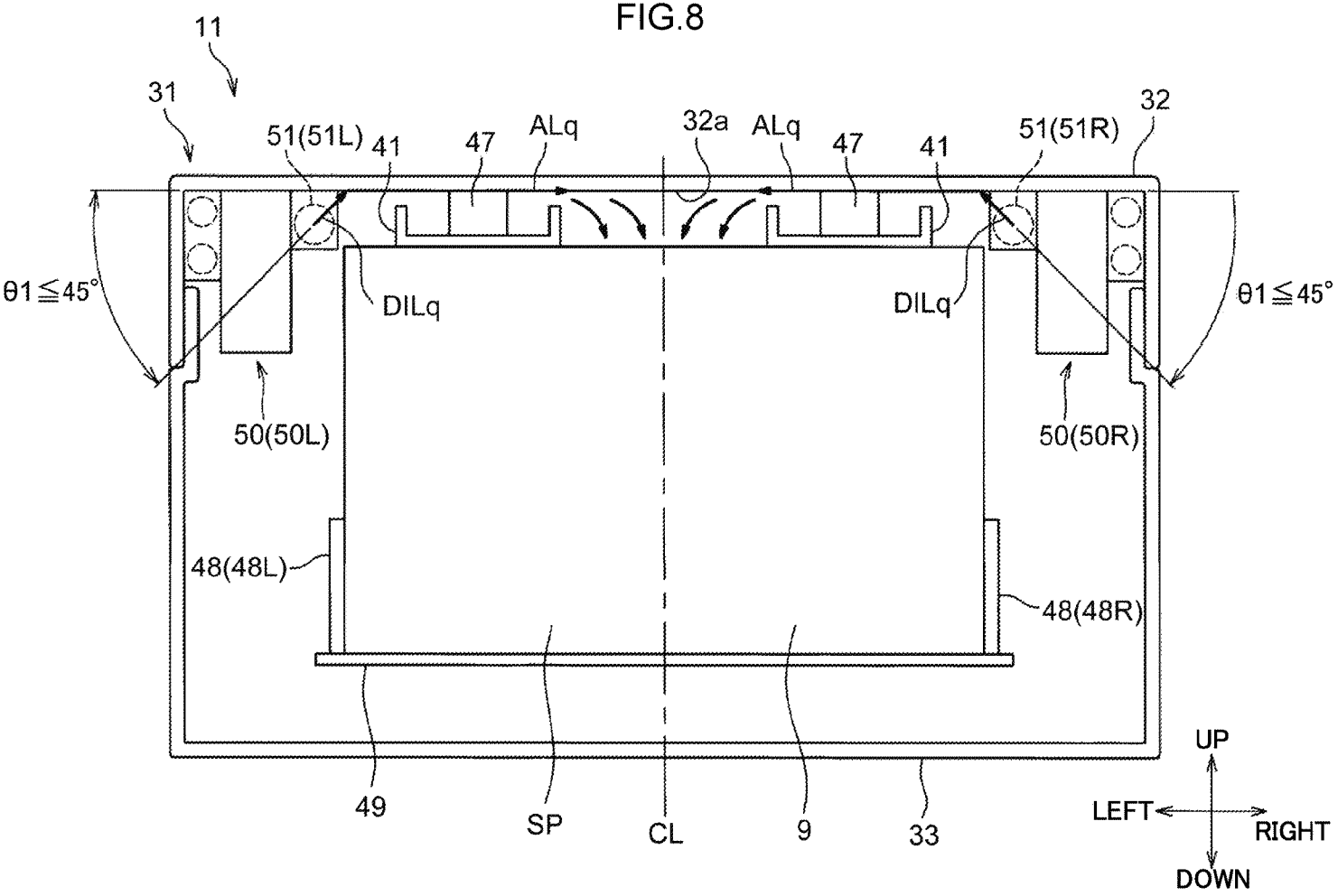
FIG. 8 is an explanatory diagram illustrating action during operation of a liquid ejection mechanism of a medium storage box according to the first exemplary embodiment.

Explanation follows regarding action during operation of the liquid ejection mechanisms 50 of the medium storage box 11, with reference to FIG. 6A, FIG. 6B, FIG. 6C and FIG. 8. FIG. 8 is an explanatory diagram illustrating action during operation of the liquid ejection mechanisms 50 of the medium storage box 11.

During operation of each liquid ejection mechanism 50, first, the pressure generating portion 55 (see FIG. 6A) presses the liquid extrusion plate 54 toward the storage portion 53 side. The liquid extrusion plate 54 is moved toward the storage portion 53 side due to receiving pressure from the pressure generating portion 55 side and compresses the storage portion 53 toward the ejection valves 57 side.

When this is performed, the ejection valves 57 deform from a shape projecting out toward the storage portion 53 side into a shape projecting out toward the route block 56 side. Ink thereby flows from the storage portion 53 into the route block 56, and then flows into the liquid ejection nozzle 51 coupled to the route block 56. Then, ink is ejected from the liquid ejection holes 65 of the liquid ejection nozzle 51 toward the lower face 32*a* of the lid section 32 (see FIG. 8). The arrows Alq illustrated in FIG. 8 illustrates the flow of ink.

The right liquid ejection nozzle 51R and the left liquid ejection nozzle 51L eject ink at substantially the same timing. Ink ejected from the two respective liquid ejection nozzles 51R, 51L strikes the lower face 32*a* of the lid section 32, and flows along the lower face 32*a* in the direction of the center CL of the medium storage box 11. As a result, the flow of ink ejected from the right liquid ejection nozzle 51R and the flow of ink ejected from the left liquid ejection nozzle 51L collide near the center CL of the medium storage box 11. When this occurs, the ink drips down into the storage space SP from the lower face 32*a*. The medium storage box 11 thereby applies ink to each of the banknotes 9 stored in the storage space SP.

Note that through experimentation, a good flow of ink in the direction of the center CL was confirmed for cases in which an internal angle θ1 between the central direction of ejections DILq of the liquid ejection nozzles 51 and at least the portion of the lower face 32*a* of the lid section 32 onto which ink is ejected was set to 45° or less. Therefore, the internal angle θ1 is preferably set to 45° or less. However, the internal angle θ1 may be a value within a desired angular margin of error (for example, a value of 55° or less in a case in which the margin of error is 10°).

(9) Main Features of Medium Storage Box

Explanation follows regarding main features of the medium storage box 11, in comparison to conventional medium storage boxes.

(a) A conventional medium storage box is configured such that liquid ejection nozzles are disposed above a storage space, and ink is ejected directly onto banknotes from the liquid ejection nozzles. In such a conventional medium storage box, the liquid ejection nozzles are disposed above the storage space. Accordingly, the liquid ejection nozzles limit the disposable space for a member (for example, an upper guide or the like) to be disposed above the storage space.

In contrast thereto, the medium storage box 11 according to the first exemplary embodiment is configured such that the liquid ejection nozzles 51 are disposed at positions displaced from the top of the storage space SP, and such that ink is not ejected directly onto the banknotes 9 from the liquid ejection nozzles 51 and instead ink is ejected obliquely from below toward a lower face of the upper installation member (in this case, the lower face 32*a* of the lid section 32), and ink drips down from this lower face. In such a medium storage box 11, in contrast to the conventional medium storage box, the liquid ejection nozzles 51 are not disposed above the storage space SP. The liquid ejection nozzles 51 thus do not limit the disposable space for a member (for example, an upper guide 41 or the like) to be disposed above the storage space SP can be disposed. Accordingly, the medium storage box 11 enables a comparatively wide space to be secured above the storage space SP, and enables the disposable space for a member (for example, an upper guide or the like) to be disposed above the storage space SP to be larger than that of the conventional medium storage box.

(b) A conventional medium storage box is configured such that ink is ejected directly onto banknotes from the liquid ejection nozzles. In such a conventional medium storage box, in order to stain the banknotes over a wide area, it is necessary to separate the liquid ejection nozzles from an upper end of the storage space by a specific distance or greater above the storage space. Thus, in the conventional medium storage box, extra room must be provided in the up-down direction height dimension of the casing, resulting in a commensurate increase in size.

In contrast thereto, the medium storage box 11 according to the first exemplary embodiment is configured such that ink is not ejected directly onto the banknotes 9 from the liquid ejection nozzles 51. In such a medium storage box 11, there is no need to separate the liquid ejection nozzles 51 from an upper end of the storage space SP (specifically, the maximum size medium storage space SPmax) by a specific distance or greater above the storage space SP. Thus, in the medium storage box 11, in contrast to a conventional medium storage box, there is no need to provide extra room in the up-down direction height dimension of the casing 31, and there is no need to increase the size of the medium storage box 11. Accordingly, the medium storage box 11 can be reduced in size compared to the conventional medium storage box.

(c) A conventional medium storage box is configured such that the liquid ejection nozzles are disposed the storage space. The liquid ejection nozzles eject ink spreading in all directions from the liquid ejection holes. The upper guides are also disposed at comparatively lower positions in cases in which banknotes of a comparatively small size are stored in the storage space. In cases in which banknotes of a comparatively small size are stored in the storage space (namely, in cases in which the upper guides are disposed at a comparatively low position), in such a conventional medium storage box, ink is ejected so as to spread in all directions, and as the upper guides are sometimes in the way in the ink ejection direction, it is possible that ink will strike the upper faces of the upper guides. In such a case, the upper guides obstruct application of the ink to the banknotes. Accordingly, in the conventional medium storage box it is possible that the banknotes cannot be stained well using a small amount of ink. Note that it is conceivable for this issue to be resolved if configuration is made such that the liquid ejection nozzles are disposed between the two upper guides. However, due to relationships with other components and the mounting space in such a configuration, this is not preferable since the liquid ejection nozzles may limit the disposable space for a member (for example, an upper guide or the like) to be disposed above the storage space (see item (a) above), or it may be necessary to provide extra room in the up-down direction height dimension of the casing (see item (b) above).

In contrast thereto, the medium storage box 11 according to the present exemplary embodiment is configured such that the liquid ejection nozzles 51 are not disposed above the storage space SP, and instead is configured such that ink is ejected obliquely from the lower right and obliquely from the lower left onto the lower face 32*a* of the lid section 32. In such a medium storage box 11, the flow of ink from the left side and the flow of ink from the right side collide near a center CL (see FIG. 7) of the medium storage box 11, and ink drips down under its own weight into the storage space SP from the lower face 32*a* of the lid section 32. In cases in which banknotes 9 of comparatively small size are stored in the storage space SP, and even when the upper guides 41 are disposed at a comparatively low position, as ink does not spread in all directions as in a conventional medium storage box, such a medium storage box 11 enables suppressing a comparatively large amount of ink from striking the upper face of the upper guides 41. Accordingly, the medium storage box 11 enables the amount of ink applied to the banknotes 9 to be increased, and enables the banknotes 9 to be better stained by a smaller amount of ink than in a conventional medium storage box.

(d) Plural of the holes 44 (see FIG. 5A and FIG. 5B) are formed in the upper guides 41 of the medium storage box 11 according to the first exemplary embodiment. Accordingly, in the medium storage box 11, even if ink were to drip down onto an upper face side of the upper guides 41, the ink would pass through the respective holes 44 and drip down into the storage space SP without accumulating on the upper faces of the upper guides 41. Thus, the medium storage box 11 enables a larger amount of ink to be supplied to the storage space SP than in a conventional medium storage box. Accordingly, in this manner as well, the medium storage box 11 enables the banknotes 9 to be better stained by a smaller amount of ink than in the conventional medium storage box.

(e) In conventional medium storage boxes, as the liquid ejection nozzles limit the disposable space for a member (for example, an upper guide or the like) to be disposed above the storage space, the storage boxes need to be developed for each denomination. Accordingly, the cost of conventional medium storage boxes tends to be high.

In contrast thereto, in the medium storage box 11 according to the first exemplary embodiment, as the liquid ejection nozzles do not limit the disposable space for a member (for example, an upper guide or the like) to be disposed above the storage space, there is no need to develop a storage box for each denomination. Thus, the medium storage box 11 enables costs to be suppressed compared to conventional medium storage boxes. The medium storage box 11 also enables the banknotes 9 to be reliably stained, thus security is not reduced.

In the above ways, the medium storage box 11 according to the first exemplary embodiment enables enlargement of the disposable space for a member (for example, an upper guide 41) to be disposed above a storage space SP storing a paper sheet-shaped medium (banknotes 9).

Second Exemplary Embodiment

In the medium storage box 11 according to the first exemplary embodiment described above, the shape of the lower face 32*a* of the lid section 32 onto which ink is ejected is a flat, horizontal face overall (particularly, the shape of at least a portion of the lower face 32*a* onto which ink is ejected is a flat, horizontal face).

In contrast thereto, the second exemplary embodiment provides a medium storage box 111 configured such that the shape of the lower face 32*a* of the lid section 32 onto which ink is ejected (particularly, the shape of at least a portion of the lower face 32*a* onto which ink is ejected) includes a flat horizontal face and a flat inclined face.

Figure 9:
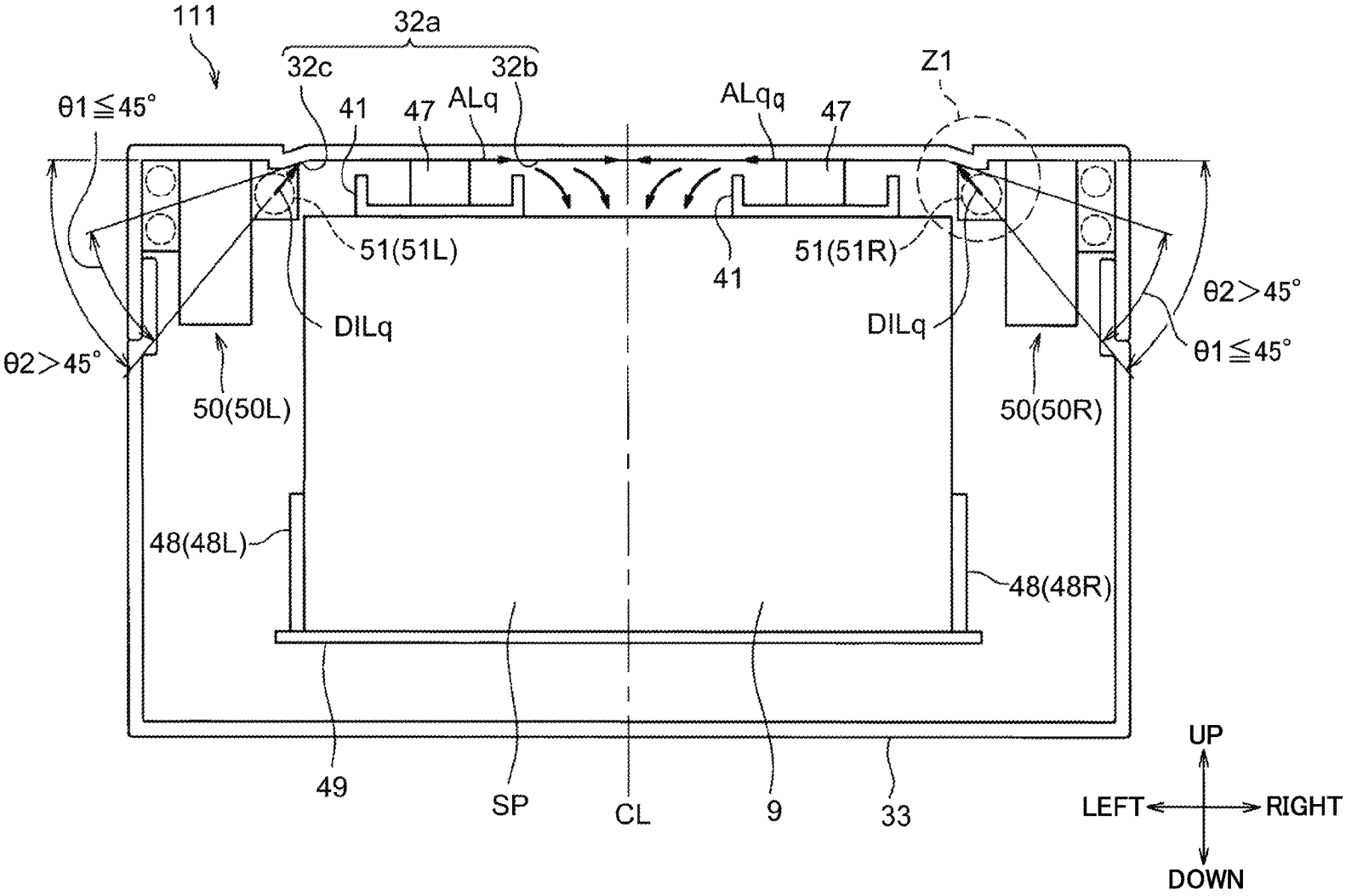
FIG. 9 is a diagram illustrating configuration of the inside of a medium storage box according to a second exemplary embodiment.
Figure 10:
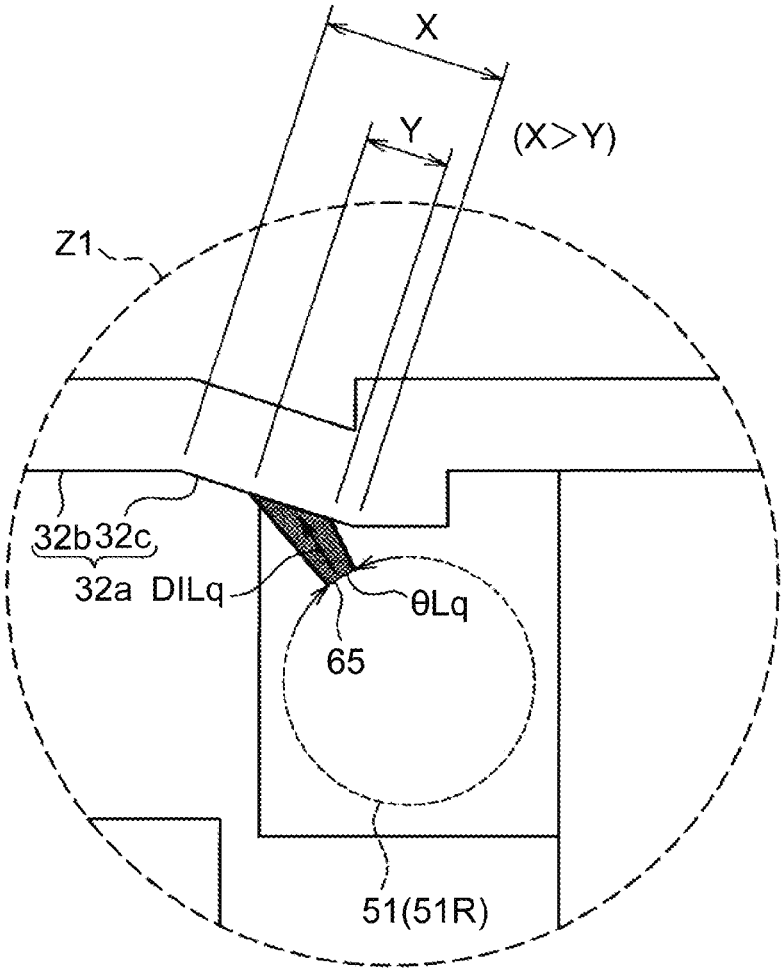
FIG. 10 is a diagram illustrating configuration of relevant portions of a medium storage box according to the second exemplary embodiment.

Explanation follows regarding the medium storage box 111 according to the second exemplary embodiment, with reference to FIG. 9 and FIG. 10. FIG. 9 is a diagram illustrating configuration the interior of the medium storage box 111. FIG. 10 is a diagram illustrating configuration of relevant portions of the medium storage box 111. FIG. 10 is an enlarged illustration of configuration in a region Z1 illustrated in FIG. 9.

As illustrated in FIG. 9, the medium storage box 111 according to the second exemplary embodiment differs from the medium storage box 11 according to the first exemplary embodiment (see FIG. 8) in that the shape of the lower face 32*a* of the lid section 32 onto which ink is ejected (particularly, the shape of at least the portion of lower face 32*a* onto which ink is ejected) is configured including flat horizontal faces 32*b* and flat inclined faces 32*c*.

Each inclined face 32*c* has a profile sloping downward to a side nearest to the liquid ejection nozzles 51 from the side furthest from the liquid ejection nozzles 51. The liquid ejection nozzles 51 eject ink toward the inclined faces 32*c*. An internal angle θ1 between the central direction of ejection DILq of each liquid ejection nozzle 51 and the respective inclined face 32*c* is set to 45° or less. Further, an internal angle θ2 between the central direction of ejection DILq of each liquid ejection nozzle 51 and the respective horizontal face 32*b* is set to greater than 45°. Herein, "central direction DILq" means the central direction of the ejection directions of ink ejected from the liquid ejection holes 65 inside an ejection angle θLq (see FIG. 10).

As illustrated in FIG. 10, the position at which the liquid ejection nozzles 51 are disposed with respect to the respective inclined face 32*c* (namely, the distance from the inclined face 32*c* to the liquid ejection nozzles 51) is set such that a width Y over which ink strikes the lower face 32*a* of the lid section 32 is smaller than a width X of the inclined face 32*c*.

In this configuration, the medium storage box 111 according to the second exemplary embodiment has the following operation and advantageous effects compared to the medium storage box 11 according to the first exemplary embodiment.

For example, in the medium storage box 11 according to the first exemplary embodiment, if the value of the internal angle (internal angle θ1 illustrated in FIG. 8) between the liquid ejection nozzles 51 and the lower face 32*a* of the lid section 32 were to be set greater than 45°, the incidence angle (namely, the internal angle θ1) of ink against the portion of the lower face 32*a* of the lid section 32 onto which ink is ejected would become greater than 45°. The amount of ink that flows in the direction of the center CL would thus be reduced. Accordingly, in the medium storage box 11, if the value of the internal angle between the liquid ejection nozzles 51 and the horizontal face of the lower face 32*a* of the lid section 32 were to be set greater than 45°, the staining efficiency of the banknotes 9 would be reduced.

In contrast thereto, in the medium storage box 111 according to the second exemplary embodiment, although the internal angle (internal angle θ2 illustrated in FIG. 9) between the liquid ejection nozzles 51 and the respective horizontal face 32*b* of the lower face 32*a* of the lid section 32 is set greater than 45°, the incidence angle (namely, the internal angle θ1) of ink against the portion of the lower face 32*a* of the lid section 32 onto which ink is ejected (the inclined face 32*c*) is maintained at 45° or less. Thus, the amount of ink that flows in the direction of the center CL is not reduced. Accordingly, in the medium storage box 1111, although the value of the internal angle between the liquid ejection nozzles 51 and the respective horizontal face 32*b* of the lower face 32*a* of the lid section 32 is set greater than 45°, the staining efficiency of the banknotes 9 is not reduced.

In such a medium storage box 111, the liquid ejection nozzles 51 can be disposed more greatly inclined toward the respective horizontal face 32*b* of the lower face 32*a* of the lid section 32 than in the medium storage box 11 according to the first exemplary embodiment. Accordingly, the medium storage box 111 enables the degree of freedom of configuration for disposing the liquid ejection nozzles 51 to be increased.

In the above way, the medium storage box 111 according to the second exemplary embodiment enables enlargement of the disposable space for a member (for example, an upper guide 41) to be disposed above a storage space SP storing a paper sheet-shaped medium (banknotes 9), similarly to the medium storage box 11 according to the first exemplary embodiment.

Moreover, in the medium storage box 111, as the liquid ejection nozzles 51 can be disposed more greatly inclined toward the respective horizontal face 32*b* of the lower face 32*a* of the lid section 32 compared to the medium storage box 11 according to the first exemplary embodiment, the degree of freedom of configuration for disposing the liquid ejection nozzles 51 can be increased.

Note that the present invention is not limited to the above exemplary embodiments, and various modifications and changes may be implemented within a range not departing from the spirit of the present invention.

For example, the above exemplary embodiments have been explained in detail in order to facilitate understanding of the spirit of the present invention. Thus, the present invention is not necessarily limited to including all the configurations explained. Moreover, other configuration may be added to or exchanged with the configuration of the exemplary embodiments of the present invention. In the present invention, partial configuration may also be omitted from the configurations of the exemplary embodiments.

For example, the present invention may be utilized not only in cash handling devices such as a cash dispenser (CD) or an automatic teller machine (ATM), but also in other devices such as a ticket machine.

First Modified Example

Figure 11:
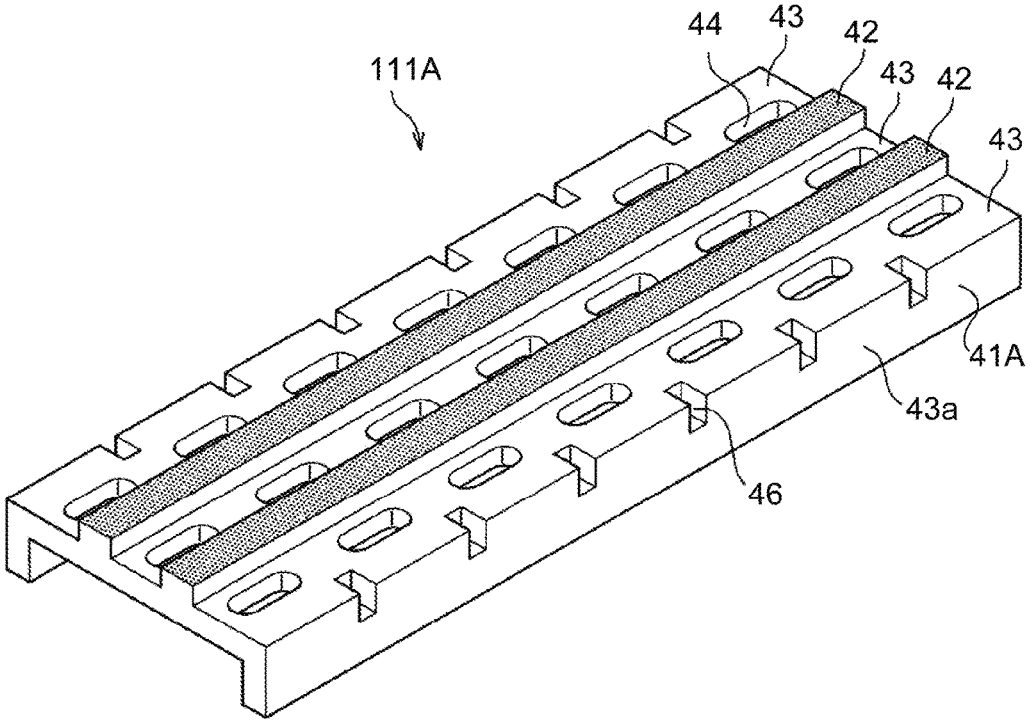
FIG. 11 is a diagram illustrating configuration of a medium storage box according to a first modified example.

For example, the upper guides 41 can be modified as in an upper guide 41A of a medium storage box 111A illustrated in FIG. 11. FIG. 11 is a diagram of configuration of the medium storage box 111A according to a first modified example. As illustrated in FIG. 11, plural openings 46 that pierce through to an upper face (not illustrated) of the upper guide 41 are formed in portions spanning from the non-restricting faces 43 of the upper guide 41A of the medium storage box 111A to a respective side face 43*a*. Accordingly, ink that has accumulated on the upper face side of the upper guide 41A passes through not only the holes 44, but the openings 46, and drips down into the storage space SP. Note that configuration may be made in which the openings 46 are only formed in the side faces 43*a*, and not in portions spanning from the non-restricting faces 43 to the respective side face 43*a*.

Such a medium storage box 111A enables a larger amount of ink to be supplied to the storage space SP in a short amount of time than in the medium storage box 11 according to the first exemplary embodiment. Accordingly, the medium storage box 111A enables better staining of the banknotes 9 in a short amount of time than in the medium storage box 11 according to the first exemplary embodiment.

Second Modified Example

Figure 12:
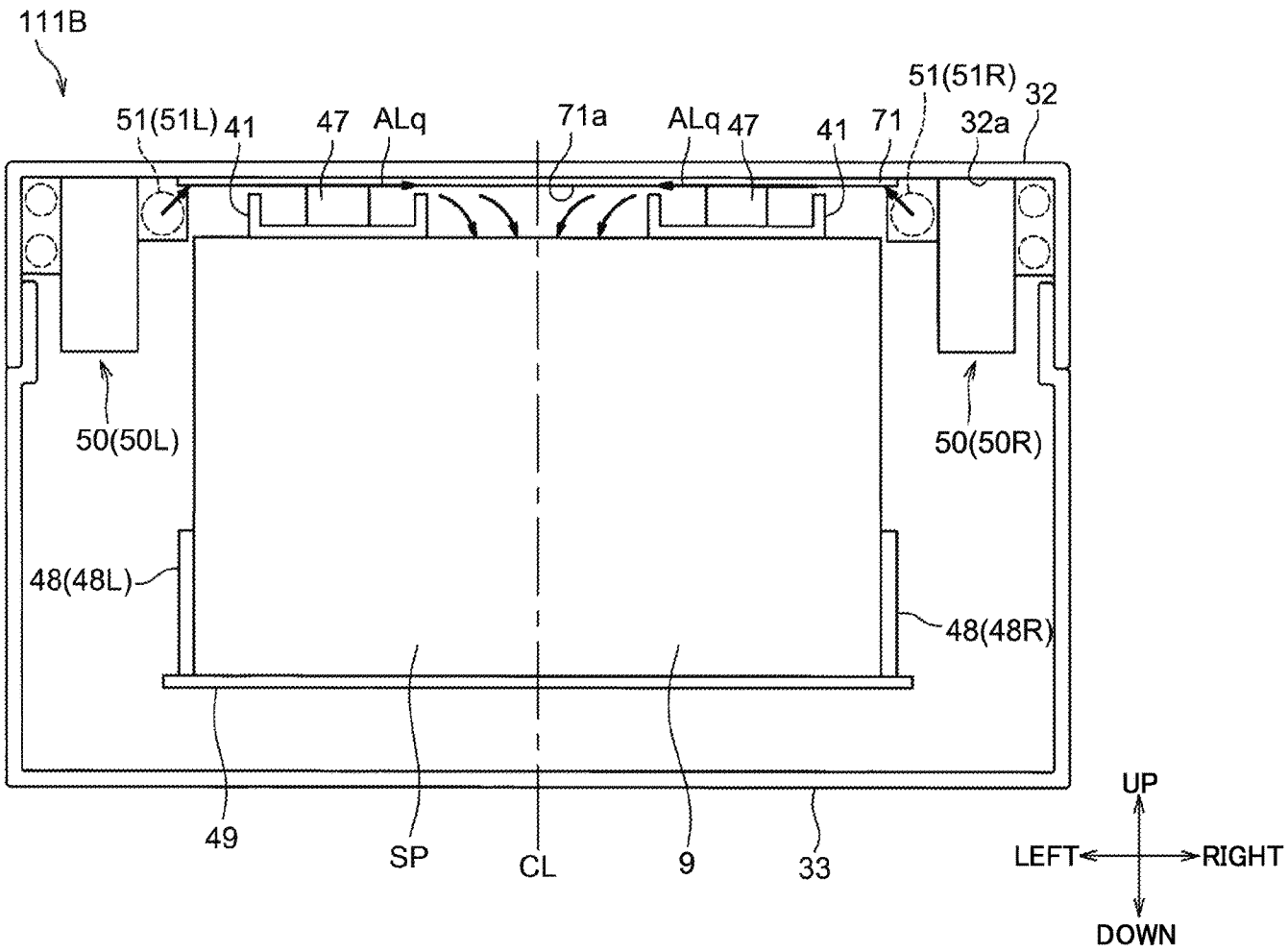
FIG. 12 is a diagram illustrating configuration of a medium storage box according to a second modified example.

Additionally, for example, the medium storage box 11 according to the first exemplary embodiment is configured such that ink is ejected toward the lower face 32*a* of the lid section 32. Namely, the medium storage box 11 according to the first exemplary embodiment described above is configured employing the lid section 32, this being an upper member of the casing 31, as an "upper installation member" onto which ink is ejected (the medium storage box 111 according to the second exemplary embodiment is also similar). However, the medium storage box 11, for example, may be modified with a configuration employing a member other than the lid section 32 as the "upper installation member", as in a medium storage box 111B illustrated in FIG. 12. FIG. 12 is a diagram of configuration of the medium storage box 111B according to the second modified example.

As illustrated in FIG. 12, the medium storage box 111B is configured so as to include an intermediary member 71 between the lid section 32 and the storage space SP. The medium storage box 111B is further configured such that ink is ejected toward a lower face 71*a* of the intermediary member 71.

In cases in which the intermediary member 71 is configured from a material that is ink-resistant, for example, such a medium storage box 111B may be configured such that the lid section 32 is not configured from a material that is ink-resistant. Accordingly, the medium storage box 111B enables the degree of freedom for design of the lid section 32 to be increased, and enables the cost for manufacturing the lid section 32 to be reduced.

Third Modified Example

Figure 13:
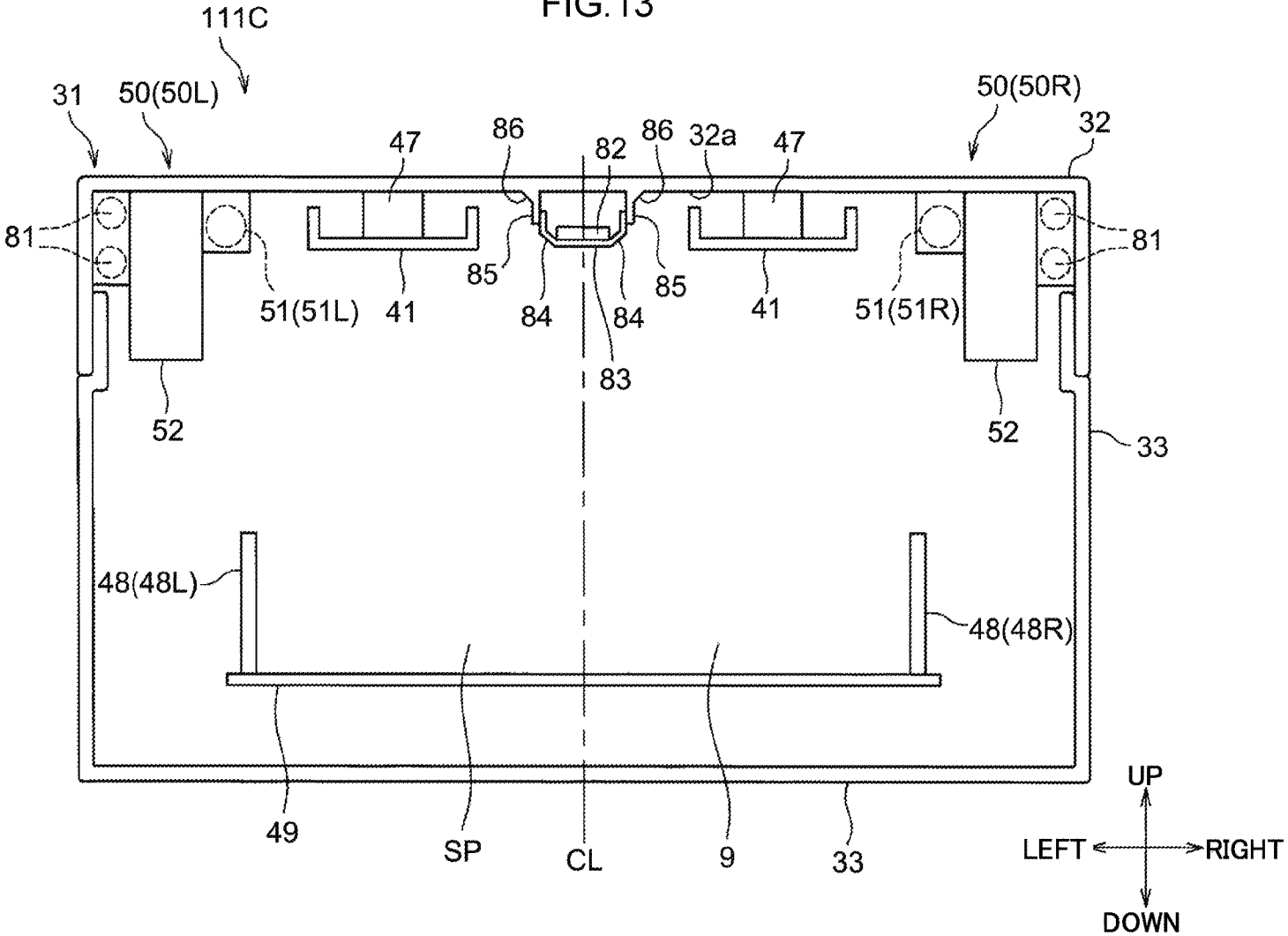
FIG. 13 is a diagram illustrating configuration of a medium storage box according to a third modified example.

Additionally, for example, the medium storage box 11 may be modified with a configuration in which, as in a medium storage box 111C illustrated in FIG. 13, for example, various members are disposed on the lower face 32*a* side of the lid section 32, this being an upper member of the casing 31, and these members are replaced together as a group by replacing the lid section 32. FIG. 13 is a diagram of configuration of the medium storage box 111C according to the third modified example.

As illustrated in FIG. 13, the casing 31 of the medium storage box 111C is configured such that the lid section 32, this being an upper member thereof, and the container section 33, this being a lower member thereof, can be separated from each other. Members such as a battery 81, a substrate 82, a substrate cover 83 that covers the substrate 82, and the liquid ejection mechanisms 50 are attached to the lower face 32*a* side of the lid section 32.

The battery 81 and the liquid ejection mechanism 50 are disposed at positions on the lower face 32*a* of the lid section 32 displaced from the top of the storage space SP. The substrate 82 and the substrate cover 83, on the other hand, are disposed on the lower face 32*a* of the lid section 32 above the storage space SP. The battery 81 supplies electricity to the substrate 82 and the liquid ejection mechanisms 50.

The substrate 82 and the substrate cover 83 are preferably disposed near the center CL of the medium storage box 111C such that ink that has been ejected from the two liquid ejection nozzles 51R, 51L drips down near the center CL of the medium storage box 111C.

Note that ribs 85 that form a seal between the lower face 32*a* and the substrate cover 83 are formed to the lower face 32*a* of the lid section 32. Inclined faces 84 are also formed on an exposed face of the substrate cover 83, and inclined faces 86 are formed on exposed faces of the ribs 85. The medium storage box 111C enables dripping of the ink to be promoted using the inclined faces 84, 86. Accordingly, the medium storage box 111C enables the banknotes 9 to be better stained by a small amount of ink.

In such a medium storage box 111C, these members can be replaced together as a group just by replacing the lid section 32. Additionally, the medium storage box 111C enables, for example, a configuration that includes the liquid ejection mechanisms 50 to be easily changed to a configuration that does not include the liquid ejection mechanisms 50 by just replacing the lid section 32.

The medium storage box 111C also enables substrates 82 loaded with control programs with different specifications to be employed in accordance with the application by just replacing the lid section 32. Accordingly, the medium storage box 111C can be loaded with new functionality being added.

Note that functionality implemented by the substrate 82 can include, for example, control functionality to operate the liquid ejection mechanisms 50. This control functionality, for example, may be configured such that a non-illustrated controller mounted on the substrate 82 operates the liquid ejection mechanisms 50 based on its own decisions, or may be configured such that a non-illustrated controller mounted on the substrate 82 operates the liquid ejection mechanisms 50 according to operation instructions transmitted from the medium handling device 1 side.

Functionality implemented by the substrate 82 can also include, for example, abnormality detection functionality to detect abnormalities in things such as the interior and exterior temperatures of the medium storage box 111C or an ink ejection angle.

Additionally, functionality implemented by the substrate 82 can include, for example, wireless communication functionality to perform wireless communication with the medium handling device 1. Note that the content of communications transmitted from the substrate 82 side to the medium handling device 1 side can include, for example, denomination information and sheet count information for banknotes 9 stored in the medium storage box 111C, detection information in cases in which an abnormality was detected, operation information in cases in which the liquid ejection mechanisms 50 were operated, or the like. The content of communications transmitted from the medium handling device 1 side to the substrate 82 side can also include, for example, pay-out instructions, operation instructions for the liquid ejection mechanism 50, or the like.

The disclosure of Japanese Patent Application No. 2015-034822 is incorporated in its entirety by reference herein.

All publications, patent applications, and technical standards mentioned in the present specification are incorporated by reference in the present specification to the same extent as if each individual publication, patent application, or technical standard was specifically and individually indicated to be incorporated by reference.

The invention claimed is:

1. A medium storage box including an internal storage space for storing a paper sheet-shaped medium, the medium storage box comprising:

an upper installation member that is disposed above the storage space;

an upper guide that is disposed between the upper installation member and the storage space, and that restricts an up-down direction position of the medium, and a liquid ejection mechanism that ejects liquid from a liquid ejection nozzle, the liquid ejection nozzle being disposed between the upper installation member and the upper guide at a position displaced from the top of the storage space toward the outside, wherein a liquid ejection direction of the liquid ejection nozzle is set in a direction toward a lower face of the upper installation member.

2. The medium storage box of claim 1, wherein:

a lower face of the upper guide includes a restricting face that restricts the up-down direction position of the medium, and a non-restricting face that is not the restricting face; and the non-restricting face being formed with a hole piercing through to an upper face side of the upper guide.

3. The medium storage box of claim 2, wherein an edge portion of the hole has a chamfered shape.

4. The medium storage box of claim 1, wherein:

a lower face of the upper guide includes a restricting face that restricts the up-down direction position of the medium, and a non-restricting face that is not the restricting face; and an opening is formed piercing through to an upper face side of the upper guide either at a portion spanning from the non-restricting face to a side face of the upper guide, or at a side face of the upper guide.

5. The medium storage box of claim 1, wherein:

a casing of the medium storage box includes an upper member configuring an upper side and a lower member configuring a lower side configured so as to be separable from each other; and a substrate, a substrate cover that covers the substrate, and the liquid ejection nozzle are attached to a lower face side of the upper member.

6. The medium storage box of claim 5, wherein:

the substrate and the substrate cover are disposed on a portion of a lower face of the upper member positioned above the storage space; and the lower face of the upper member is formed with a rib that forms a seal between the lower face and the substrate cover.

7. The medium storage box of claim 6, wherein an inclined face that promotes dripping of the liquid is formed to an exposed face of the substrate cover and to an exposed face of the rib.

8. The medium storage box of claim 1, wherein:

the upper installation member is an upper member configuring an upper side of a casing of the medium storage box.

9. The medium storage box of claim 1, wherein:

the upper installation member is an intermediary member disposed between an upper member configuring an upper side of a casing of the medium storage box and the storage space.

10. A medium storage box including an internal storage space for storing a paper sheet-shaped medium, the medium storage box comprising:

an upper installation member that is disposed above the storage space; and a liquid ejection mechanism that ejects liquid from a liquid ejection nozzle, wherein a liquid ejection direction of the liquid ejection nozzle is set in a direction toward a lower face of the upper installation member, and an internal angle between the liquid ejection direction of the liquid ejection nozzle and at least a portion of the lower face of the upper installation member onto which the liquid is ejected is set to 45° or less.

11. The medium storage box of claim 10, wherein:

the lower face of the upper installation member includes a horizontal face and an inclined face;

the inclined face has a profile sloping downward to a side nearest to the liquid ejection nozzle from a side furthest from the liquid ejection nozzle; and the liquid ejection nozzle ejects the liquid toward the inclined face.

12. The medium storage box of claim 11, wherein:

an internal angle between the liquid ejection direction of the liquid ejection nozzle and the horizontal face is set greater than 45°; and an internal angle between the liquid ejection direction of the liquid ejection nozzle and the inclined face is set to 45° or less.

13. A medium handling device that handles a medium, the medium handling device comprising:

the medium storage box of claim 10.

14. The medium storage box of claim 10, wherein:

a casing of the medium storage box includes an upper member configuring an upper side and a lower member configuring a lower side configured so as to be separable from each other; and a substrate, a substrate cover that covers the substrate, and the liquid ejection nozzle are attached to a lower face side of the upper member.

15. The medium storage box of claim 14, wherein:

the substrate and the substrate cover are disposed on a portion of a lower face of the upper member positioned above the storage space; and the lower face of the upper member is formed with a rib that forms a seal between the lower face and the substrate cover.

16. The medium storage box of claim 15, wherein an inclined face that promotes dripping of the liquid is formed to an exposed face of the substrate cover and to an exposed face of the rib.

17. The medium storage box of claim 10, wherein:

the upper installation member is an upper member configuring an upper side of a casing of the medium storage box.

18. The medium storage box of claim 10, wherein:

the upper installation member is an intermediary member disposed between an upper member configuring an upper side of a casing of the medium storage box and the storage space.

* * * * *